US007601029B2

(12) United States Patent
Horiuchi et al.

(10) Patent No.: US 7,601,029 B2
(45) Date of Patent: Oct. 13, 2009

(54) ELECTRIC CONNECTOR ASSEMBLY KIT AND SHIELDED CABLE HARNESS

(75) Inventors: Hideaki Horiuchi, Osaka (JP); Ryo Moriwake, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 12/230,866

(22) Filed: Sep. 5, 2008

(65) Prior Publication Data

US 2009/0068890 A1 Mar. 12, 2009

(30) Foreign Application Priority Data

Sep. 6, 2007 (JP) ..... 2007-232108
Jul. 9, 2008 (JP) ..... 2008-179633

(51) Int. Cl.
*H01R 13/648* (2006.01)

(52) U.S. Cl. ..... 439/607; 439/497; 439/579

(58) Field of Classification Search ..... 439/607–610, 439/495–497, 579
See application file for complete search history.

(56) References Cited

U.S. PATENT DOCUMENTS 6,676,444 B2 * 1/2004 Noro ..... 439/579
6,705,893 B1 * 3/2004 Ko ..... 439/607.56
6,793,527 B2 * 9/2004 Noro ..... 439/579
6,932,626 B2 * 8/2005 Costello et al. ..... 439/108
7,134,888 B2 * 11/2006 Fan ..... 439/137

FOREIGN PATENT DOCUMENTS

JP 10-223269 A 8/1998
JP 2004-259672 A 9/2004
JP 2006-294572 A 10/2006

* cited by examiner

*Primary Examiner*—Truc T Nguyen
(74) *Attorney, Agent, or Firm*—Rader, Fishman & Grauer, PLLC

(57) ABSTRACT

The electric connector assembly kit is structured that the inner wire of the end of the shielded cable is fitted and held in the wire holding part of the wire holder and the outer conductor is crimped by the barrel, the connector body is set on the lower side of the wire holder, the inner conductor of the inner wire is connected to the contact and the barrel is press-fitted in the U-shaped slot, the plug cover shell is set on the higher side of the wire holder and made to contact the barrel, and the top end of the coupling piece extending toward the lower side between the U-shaped slots is bent toward the back side in the depth direction and hooked on the plug shell from the lower side to assemble onto the end of the shielded cable.

4 Claims, 19 Drawing Sheets

ELECTRIC CONNECTOR ASSEMBLY KIT AND SHIELDED CABLE HARNESS

BACKGROUND OF THE INVENTION

1. Field of the Invention

The present invention belongs to a technical field of electric connector and relates to an electric connector assembly kit to be assembled onto an end of a shielded cable, and a shielded cable harness comprising a shielded cable and an electric connector connected to an end of the shielded cable.

2. Description of the Related Art

Japanese Patent Publication (unexamined) No. 2006-294572 discloses an electric connector to be connected with a shielded cable comprising a signal line being a covered electric wire having a conductor and an insulating coating covering it, an outer conductor covering the signal line, and an outer insulating coating covering the outer conductor. The electric connector for this shielded cable comprises an insulating first housing having a line holding part for holding the exposed signal line, a conductive basic shell being fixed onto the first housing and having a crimping part to be crimping-connected to the exposed outer conductor or an insulation-displacement-connecting part to be insulation-displacement-connected to the outer conductor on a front side in a depth direction of the line holding part of the first housing, and an insulating second housing being arranged to couple with at least one of the first housing and the basic shell and having a contact for insulation-displacement-connecting with the conductor of the signal line upon coupling with the first housing or the basic shell. This patent document also discloses an auxiliary shell which contacts the circumference of the basic shell and is to be coupled with the first housing and the second housing by press-fitting. This connector for the shielded cable exhibits a better workability in connecting the shielded cable in comparison with a shielded connector using a ground plate. Moreover, as this connector reliably maintains the laid out state of the signal line of the shielded cable, the contact is reliably insulation-displacement-connected with the signal line, occurrence of defect or failure of insulation-displacement-connection can be prevented, and the workability in the laying-out work can be enhanced; thus this connector is also suitable as an electric connector for connecting a multiple-line shielded cable wherein a plurality of signal lines are twisted together and contained. Furthermore, through the enhanced shielding effect, the transmission characteristics can be enhanced as well. As the crimping part or the insulation-displacement-connection part is crimping-connected or insulation-displacement-connected to the shielded cable, the electric connector exhibits a high strength in retaining the shielded cable.

SUMMARY OF THE INVENTION

Such an electric connector is expected to stably maintain the connection between the electric connector and the shielded cable and stably maintain the assemblage of the basic shell and the auxiliary shell in the electric connector even when the shielded cable being connected to the electric connector is pulled about in relation to the electric connector; in short, it is urgently required to enhance these strengths as much as possible under severe service conditions. Here, pulling about the shielded cable in relation to the electric connector means that when the cable is pulled in a direction crossing the direction the cable normally extends straight from the end of the cable connected to the electric connector, the cable extending from the end will be bent. In that case, it may be possible to solder the outer conductor at the end of the shielded cable onto the shell, etc. of the electric connector so as to enhance the connection strength. This, however, requires the soldering work and in turn lowers the workability of the production, and it also poses a problem that solder will undergo cracking due to repeated exposure to the pulling-about forces and the performance cannot be maintained over a long period.

The present invention was made in view of such points, and its object is to enhance as much as possible the connection strength between the electric connector and the shielded cable and the assemblage strength of the shell in the electric connector against the pulling-about forces of the shielded cable by, without relying on soldering, press-fitting a crimping part of a member corresponding to said basic shell into a U-shaped slot of a plug shell and also coupling a plug cover shell being opposite to the plug shell with a housing in between to the plug shell.

The electric connector assembly kit according to the present invention is to be assembled onto an end of a shielded cable comprising an inner wire being an inner conductor covered by an inner insulating coating, an outer conductor covering the inner wire, and an outer insulating coating covering the outer conductor. This electric connector assembly kit comprises; with reference to a depth direction, a width direction, and a height direction all being perpendicular to each other, a wire holder having an insulating holder housing being provided with a groove-shaped wire holding part for holding the inner wire being exposed from the outer conductor at the end of the shielded cable and extending substantially in the depth direction, and a conductive barrel contact being fixed to the holder housing and being provided with a barrel being formed substantially into a U-shape when seen in the depth direction on the front side in the depth direction of the wire holding part of the holder housing for crimping the outer conductor exposed from the outer insulating coating at the end of the shielded cable; a connector body having an insulating body housing having a fitting part for fitting with a counterpart electric connector, a conductive contact being provided on the body housing and being to be connected to the inner conductor at the end of the shielded cable and to contact the contact of the counterpart electric connector, and a conductive plate-shaped plug shell being arranged on the lower side of the body housing to cover at least a part of the body housing, being fixed onto the body housing, and being provided with a supporting piece rising on the front side in the depth direction of the body housing and extending toward the higher side and being provided with a U-shaped slot concaving substantially in a U-shaped form when seen in the depth direction from the higher side edge of the supporting piece toward the lower side and being to receive the press-fitted barrel crimped on the outer conductor with the barrel's lower substantially half circumference contacting the U-shaped slot and the barrel's higher side protruding toward the higher side; and a conductive plate-shaped plug cover shell having a coupling piece having a width substantially corresponding to the part between the U-shaped slots in the supporting piece of the plug shell and extending from the front side in the depth direction toward the lower side; said electric connector assembly kit being structured that the inner wire of the end of the shielded cable being fitted and held in the wire holding part of the wire holder and the outer conductor being crimped by the barrel, the connector body being set on the lower side of the wire holder, the inner conductor of the inner wire being connected to the contact and the barrel being press-fitted in the U-shaped slot, the plug cover shell being set on the higher side of the wire holder and fitted with the barrel, and the top end of the coupling piece extending toward the lower side between U-shaped slots being bent toward the back side in the depth direction and hooked on the plug shell from the lower side to assemble onto the end of the shielded cable.

The end of the shielded cable is treated in advance, for example, to expose the outer conductor and the inner wire in this order toward the top end thereof. In that case, the outer conductor may be folded to cover the outer insulating coating. Then, the end of the shielded cable is arranged on the higher side of the wire holder, along the depth direction with the top end of the end of the shielded cable being on the back side, the exposed outer conductor is placed on the barrel of the barrel contact of the wire holder, then the barrel is clamped on the outer conductor to crimp the outer conductor. Before or after this crimping operation, the inner wire exposed from the outer conductor is fitted in the wire holding part of the holder housing of the wire holder, and in this way the inner wire is laid out. In that case, if necessary, the top end of the inner wire is cut to adjust. Then, the connector body is set on the lower side of the wire holder, the barrel of the barrel contact of the wire holder is press-fitted into the U-shaped slot of the plug shell of the connector body to couple the wire holder with the connector body, and the inner conductor of the inner wire is connected to the contact. Then, the plug cover shell is set on the higher side of the wire holder, the coupling piece is put between the barrels press-fitted in the U-shaped slots, and the top end of the coupling piece is bent toward the back side in the depth direction and hooked on the plug shell from the lower side. As a result, is completed a shielded cable harness comprising the shielded cable and the electric connector connected to the end of the shielded cable. Next, when the fitting part of the body housing is fitted in the counterpart electric connector, the contact will contact the contact of the counterpart electric connector. Moreover, as the outer conductor is conductive to the barrel contact, the plug shell and the plug cover shell, when the plug shell or the plug cover shell is made to contact the conductive part of the counterpart electric connector, shielding of both the electric connectors will be done satisfactorily.

In that case, in comparison with a shielded connector wherein outer conductor of shielded cable is soldered onto the ground plate, the workability of connecting the shielded cable to the electric connector is better. Furthermore, as the barrel contact is fixed to the holder housing, the barrel contact and the holder housing do not move relative to each other. Hence, when the inner wire is being laid out, even if the barrel contact or the holder housing is subjected to any force, the laid out state will be maintained reliably, and in turn, this will reliably connect the inner wire to the contact, and occurrence of defective connection or connection failure will be prevented. In particular, when inner wires of a multiple line shielded cable storing a plurality of inner wires twisted together are being laid out, even if the barrel contact or the holder housing is subjected to a restoring force due to the twisting of the inner wires, the laid-out state will be maintained reliably, and this in turn will connect the inner wires to the contacts reliably, and occurrence of defective connection or connection failure will be prevented. Moreover, as the barrel contact and the holder housing do not move relative to each other, the workability of laying out is enhanced. Furthermore, the barrel contact enhances the shielding effect, and the transmission characteristics are improved. And, as the barrel crimps the shielded cable, the electric connector exhibits a high strength of retaining the shielded cable.

Furthermore, as the barrel of the barrel contact crimps the shielded cable, the barrel is press-fitted in the U-shaped slot of the plug shell, and the barrel and the plug shell are pinched by the plug cover shell and the coupling piece, the connection strength between the electric connector and the shielded cable and the assemblage strength of the shell in the electric connector against pulling-about forces of the shielded cable are enhanced significantly in comparison with conventional products. Moreover, as soldering work of the outer conductor is not required, in comparison with the method of soldering the outer conductor of the end of the shielded cable on to the shell, etc. of the electric connector, the production workability is enhanced, and the product life extension is not hindered by solder cracking, the performance of the electric connector is maintained over a long period.

The electric connector assembly kit of the present invention may be structured that a through window penetrating the plug shell is formed between the U-shaped slots of the plug shell, and when the top end of the coupling piece of the plug cover shell is bent toward the back side in the depth direction, the top end of the coupling piece will be hooked on the edge on the front side in the depth direction of the through window.

With this arrangement, as the connection strength between the plug cover shell and the plug shell is enhanced further, the connection strength between the electric connector and the shielded cable and the assemblage strength of the shell in the electric connector are enhanced further against the pulling-about forces of the shielded cable.

The shielded cable harness of the present invention comprises a shielded cable having an inner wire being an inner conductor covered by an inner insulating coating, an outer conductor covering the inner wire, and an outer insulating coating covering the outer conductor, and exposing at the end the outer conductor and the inner wire in this order toward the top end, and an electric connector connected to the end of the shielded cable. The electric connector of this shielded cable harness comprises; with reference to a depth direction, a width direction, and a height direction all being perpendicular to each other, a wire holder having an insulating holder housing being provided with a groove-shaped wire holding part for fitting and holding the inner wire being exposed from the outer conductor at the end of the shielded cable and extending substantially in the depth direction, and a conductive barrel contact being fixed to the holder housing and being provided with a barrel being formed substantially into a ring-shape with a separation on the higher side when seen in the depth direction on the front side in the depth direction of the wire holding part of the holder housing for crimping the outer conductor exposed from the outer insulating coating at the end of the shielded cable; a connector body having an insulating body housing being set on the lower side of the wire holder and having a fitting part for fitting with a counterpart electric connector, a conductive contact being provided on the body housing and connected to the inner conductor at the end of the shielded cable and to contact the contact of the counterpart electric connector, and a conductive plate-shaped plug shell being arranged on the lower side of the body housing to cover at least a part of the body housing, being fixed onto the body housing, and being provided with a supporting piece rising on the front side in the depth direction of the body housing and extending toward the higher side and being provided with a U-shaped slot concaving substantially in a U-shaped form when seen in the depth direction from the higher side edge of the supporting piece toward the lower side and receiving the press-fitted barrel crimped on the outer conductor with the barrel's lower substantially half circumference contacting the U-shaped slot and the barrel's higher side protruding toward the higher side from the supporting piece; and a conductive plate-shaped plug cover shell being set on the higher side of the wire holder to contact the barrel and having a coupling piece having a width substantially corresponding to the part between the U-shaped slots in the supporting piece of the plug shell and extending from the front side in the depth direction toward the lower side, of which top end being bent to the back side in the depth direction and hooked on the plug shell from the lower side.

When the fitting part of the body housing of the electric connector of this shielded cable harness is fitted in the counterpart electric connector, the contact will contact the contact of the counterpart electric connector. Moreover, as the outer conductor is conductive to the barrel contact, the plug shell and the plug cover shell, if the plug shell or the plug cover shell is made to contact the conductive part of the counterpart electric connector, shielding of both the electric connectors will be done effectively. This shielded cable harness exhibits a better workability in connecting the shielded cable to the electric connector in comparison with a shielded connector wherein the outer conductor of the shielded cable is soldered to the ground plate. Moreover, as the barrel contact is fixed to the holder housing, the barrel contact and the holder housing do not move relative to each other. Hence, in laying out the inner wires, even if the barrel contact or the holder housing is subjected to any force, the laid-out state will be maintained reliably, and this in turn will securely connect the inner wire to the contact and prevent occurrence of defective connection or connection failure. In particular, when the inner wires of a multiple line shielded cable are to be laid out, even if the barrel contact or the holder housing is subjected to a restoring force due to the twisting of the inner wires, the laid-out state will be maintained reliably, and this in turn will reliably connect the inner wires to the contacts and prevent occurrence of defective connection or connection failure. Moreover, as the barrel contact and the holder housing do not move relative to each other, the workability in laying-out work is enhanced. Further, the barrel contact enhances the shielding effect, and the transmission characteristics are improved. Moreover, as the barrel crimps the shielded cable, the electric connector exhibits a high strength of holding the shielded cable.

Furthermore, as the barrel of the barrel contact crimps the shielded cable, the barrel is press-fitted in the U-shaped slot of the plug shell, and the barrel and the plug shell are pinched by the plug cover shell and the coupling piece, the connection strength between the electric connector and the shielded cable and the assemblage strength of the shell in the electric connector against pulling-about forces of the shielded cable are enhanced significantly in comparison with conventional products. Moreover, as soldering work of the outer conductor is not required, in comparison with the method of soldering the outer conductor of the end of the shielded cable on to the shell, etc. of the electric connector, the production workability is enhanced, and the product life extension is not hindered by solder cracking, the performance of the electric connector is maintained over a long period.

In the shielded cable harness of the present invention a through window penetrating the plug shell may be formed between U-shaped slots of the plug shell and the top end of the coupling piece of the plug cover shell may be hooked on the edge on the front side in the depth direction of the through window.

With this arrangement, the connection strength between the plug cover shell and the plug shell is enhanced further, and in turn the connection strength between the electric connector and the shielded cable and the assemblage strength of the shell in the electric connector against the pulling-about forces of the shielded cable are enhanced further.

DETAILED DESCRIPTION OF THE INVENTION

Figure 1:
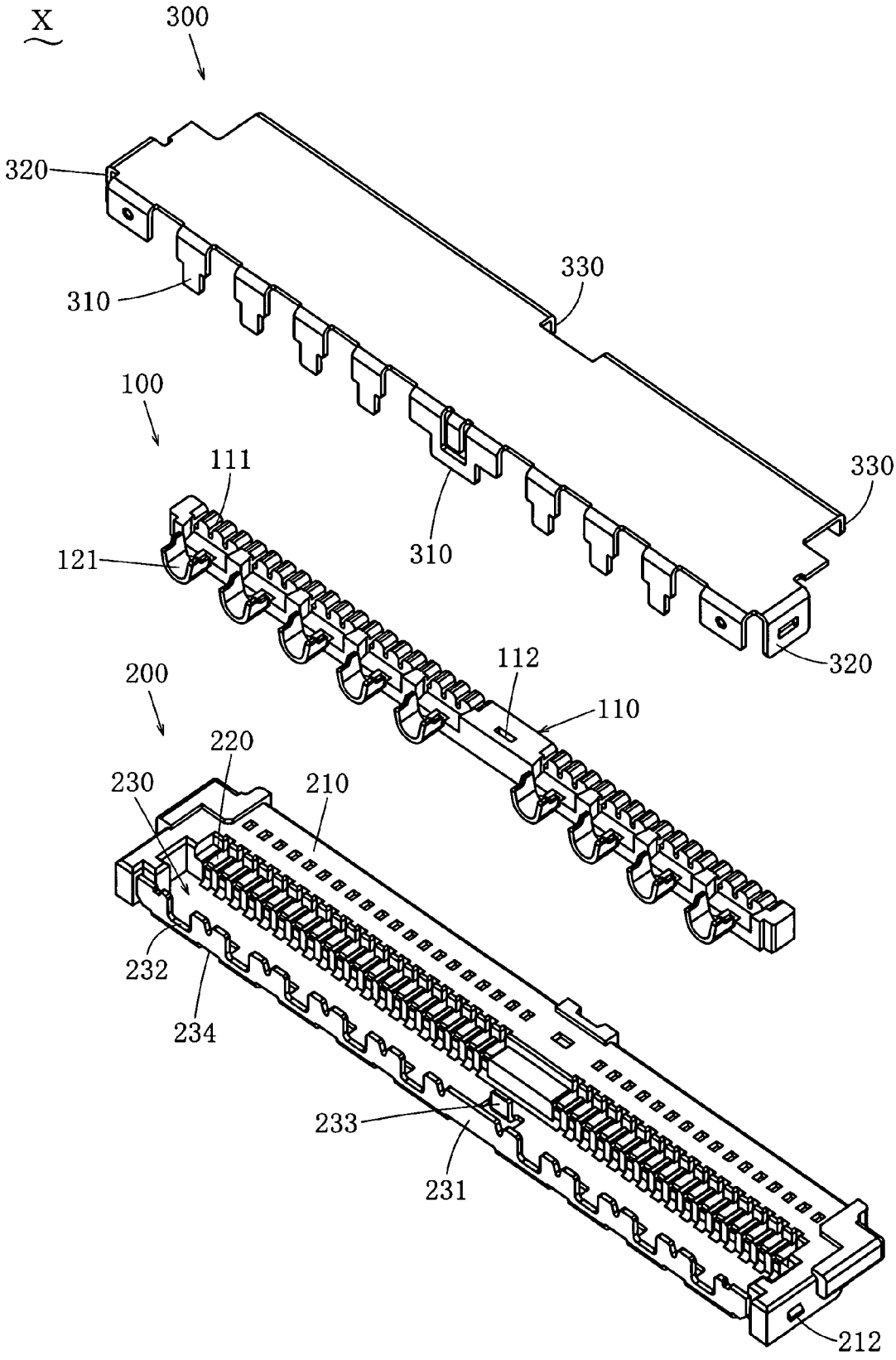
FIG. 1 is a perspective view of members comprising an embodiment of the electric connector assembly kit.

In the following, one embodiment according to the present invention will be described. FIG. 1 illustrates one embodiment of the electric connector assembly kit of the present invention. This electric connector assembly kit X is connected to ends of shielded cables 400 to form an electric connector Y. The shielded cables 400 and the electric connector Y being connected to the ends of the shielded cables 400 constitute a shielded cable harness Z.

Figure 27:
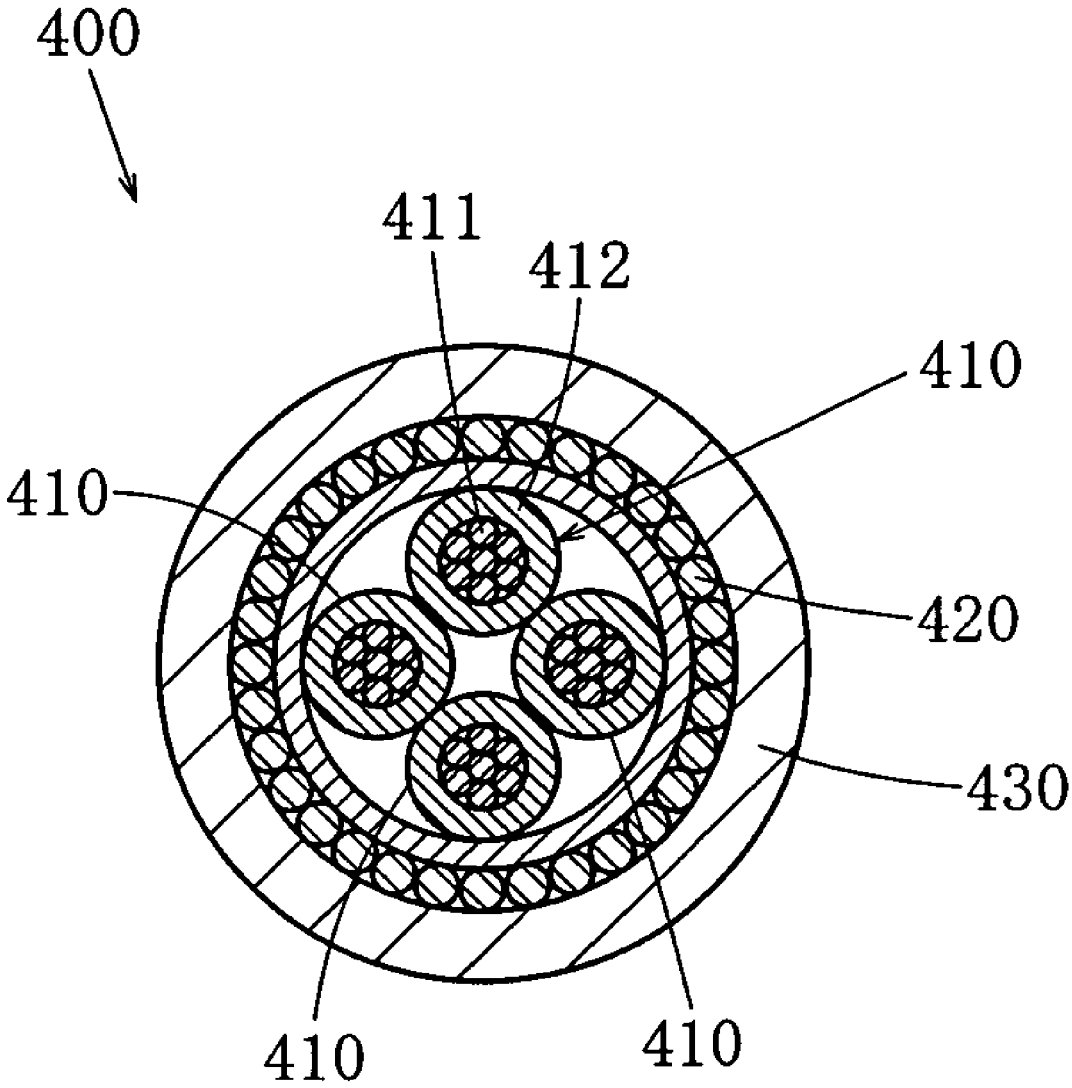
FIG. 27 is an enlarged sectional view of the shielded cable to which the electric connector assembly kit of the embodiment is to be connected.

As shown in FIG. 27, the shield cable 400 comprises inner wires 410 being inner conductors 411 covered by inner insulating coatings 412, an outer conductor 420 covering the inner wires 410, and an outer insulating coating 430 covering the outer conductor 420. This shielded cable 400 is provided with an intermediate shielding coating between the inner wires 410 and the outer conductor 420 to separate them from each other. The inner insulating coatings 412, the outer insulating coating 430 and the intermediate insulating coating are made of resin, the inner conductors 411 are formed by bundling metal wires, and the outer conductor 420 is in a form of braided wire being metal wires braided. It, however, is sufficient that the shielded cable for the present invention is provided with such inner wire, outer conductor and outer insulating coating; intermediate insulating coating may be omitted. Conversely, the present invention covers shielded cables that comprise inner wire, outer conductor, outer insulating coating, and another element. The structure of the inner conductor, inner insulating coating, outer conductor and outer insulating coating must not be construed limitedly by this embodiment; for example, the outer conductor may be of a metal foil. The shielded cable 400 of this embodiment is a multiple-wire shielded cable. This shielded cable 400 comprises a plurality of inner wires 410 twisted together and contained in the outer conductor 420. Thus the inner wires 410 are twined about each other in a spiral form. The present invention, however, also covers shielded cables wherein inner wires are not twisted and held straight. In FIG. 27 there are four inner wires 410 in the shielded cable 400, but this never limits the number of the inner wires contained in shielded cables covered by the present invention. Shielded cables containing one or more twisted pair lines are covered by the present invention. In FIG. 27, the thicknesses of the inner wires 410 contained in one shield cable 400 are identical to each other, but multiple-wire shielded cables having inner wires of varied thicknesses are also covered by the present invention. Moreover, single-wire shielded cables having only one inner wire are also covered by the present invention. A single-wire shielded cable and a multiple-wire shielded cable may be used together.

In the following, a depth direction, a width direction and a height direction all being perpendicular to each other are assumed and used for description. In the case of this embodiment, with reference to FIG. 5, FIG. 7, FIG. 10, FIG. 13, FIG. 16, FIG. 18 and FIG. 24, the top-bottom directions of these diagrams are the depth direction, the top side is the front side in the depth direction, and the bottom side is the back side in the depth direction. The left-right directions of these diagrams are the width direction. And the directions perpendicular to the paper planes of these diagrams are the height direction; getting away further from the paper plane on the face side thereof, is advancing from a relatively lower side toward a higher side in the height direction. As shown in FIG. 1, the electric connector assembly kit X comprises a wire holder 100, a connector body 200 and a plug cover shell 300.

Figure 5:
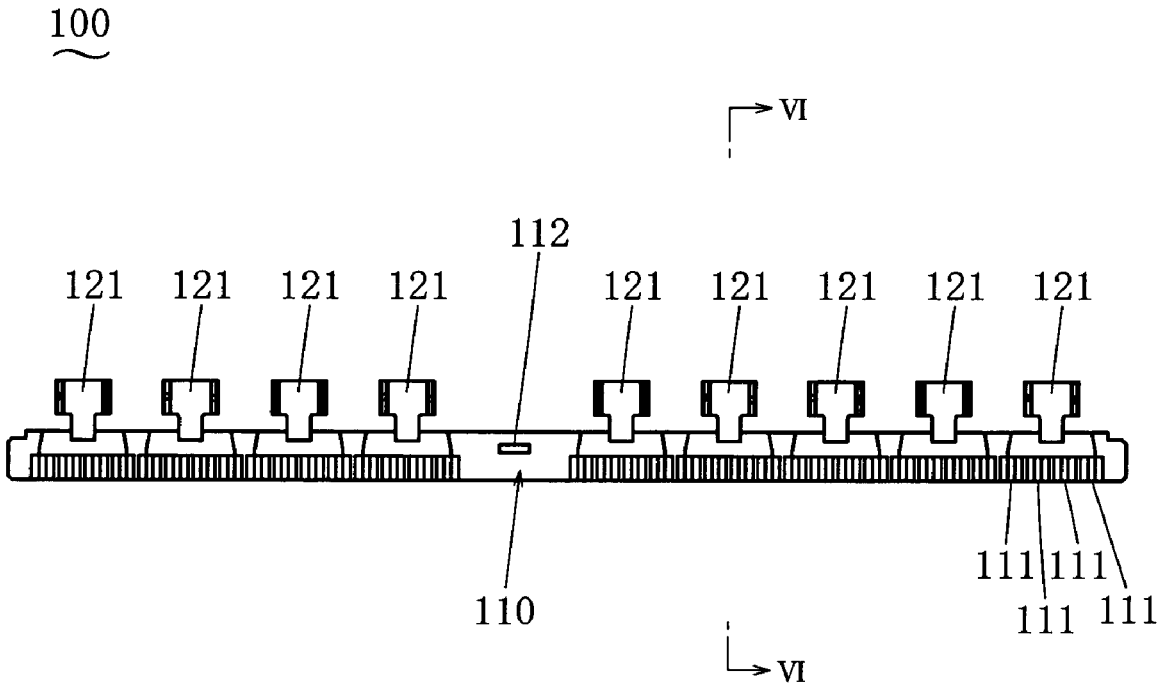
FIG. 5 is a plan view of the wire holder of the electric connector assembly kit of the embodiment.
Figure 6:
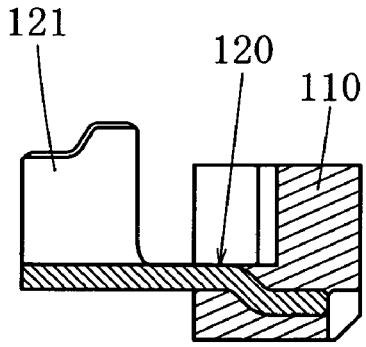
FIG. 6 is an enlarged sectional view along the line VI-VI of FIG. 5.

As shown in FIG. 5 and FIG. 6, the wire holder 100 comprises an insulating holder housing 110 and conductive barrel contacts 120 fixed in the holder housing 110. The holder housing 110 is provided with groove-shaped wire holding parts 111 extending in the depth direction. In the case of this embodiment, the shielded cable 400 has a plurality of inner wires 410, and a plurality of the shielded cables 400 are connected, hence the holder housing 110 is provided with a plurality of wire holding parts 111 arranged side by side in the width direction, of which number corresponding to the number of poles. When the inner wires 410 being exposed from the outer conductor 420 at the end of the shielded cable 400 and extending substantially in the depth direction are fitted in the wire holding part 111, forces for pinching the inner wires 410 will be generated by the flexibility of the inner wires 410 and/or the flexibility of the walls constituting the wire holding part 111, and in turn the inner wires 410 will be held by and in the wire holding part 111.

The barrel contacts 120 are plate-like members and are fixed in the holder housing 110 by integrally molding them together with the holder housing 110. This integral molding is effected by, for example, setting the barrel contacts 120 in a mold for forming the wire holder 100 and molding the holder housing 110. However, the barrel contacts may be fixed in or to the holder housing by press-fitting the barrel contacts or by other methods. The barrel contact 120 is provided with a barrel 121. In the case of this embodiment, a plurality of barrels 121, of which number corresponding to the number of poles, are arranged side by side in the width direction. One barrel contact 120 is provided with one barrel 121. Accordingly, on the holder housing 110 a plurality of barrel contacts 120, of which number corresponding to the number of poles, are fixed side by side in the width direction. However, one barrel contact may be provided with a plurality of barrels, or one barrel contact may be provided with all the barrels. The barrels 121 are provided on the front side in the depth direction of the wire holding parts 111 of the holder housing 110 to protrude toward the front side in the depth direction. The barrels 121 are formed substantially in a U-shape when seen in the depth direction. When the outer conductor 420 being exposed from the outer insulating coating 430 at the end of the shielded cable 400 is placed on the barrel 121 and both ends in the width direction of the barrel 121 are bent inward in the width direction to clamp the outer conductor 420, the barrel 121 will crimp the outer conductor 420, the barrel 121 forming a ring shape opening on the higher side.

Figure 7:
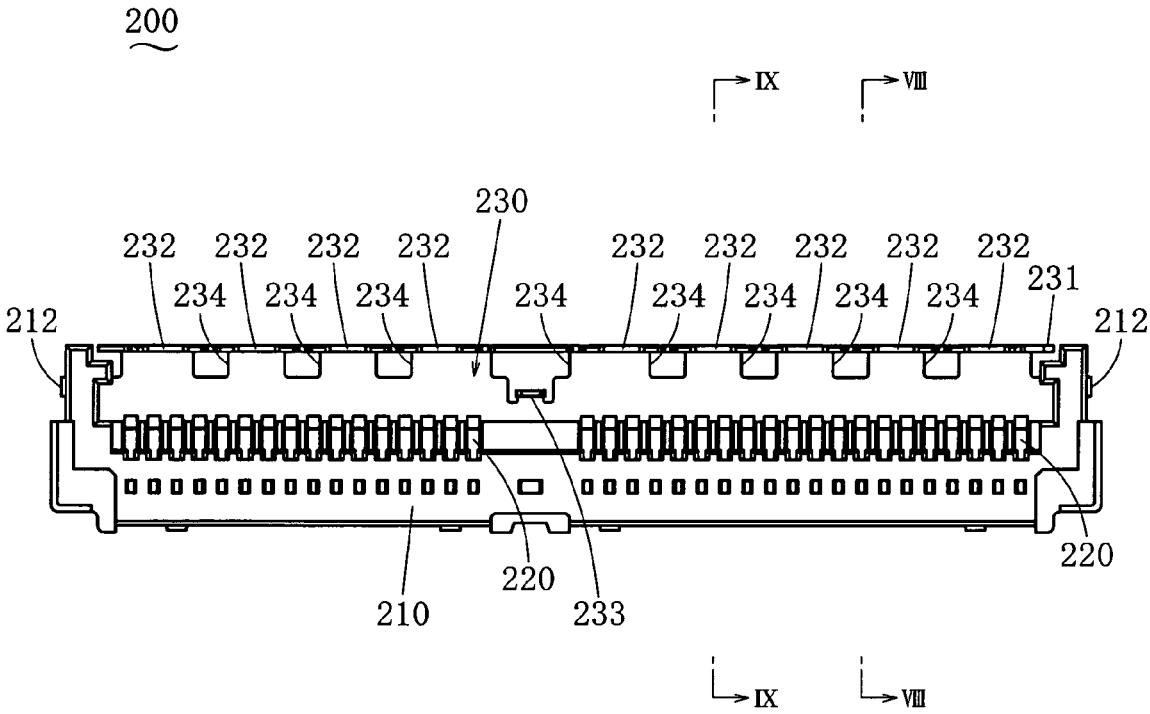
FIG. 7 is a plan view of the connector body of the electric connector assembly kit of the embodiment.
Figure 8:
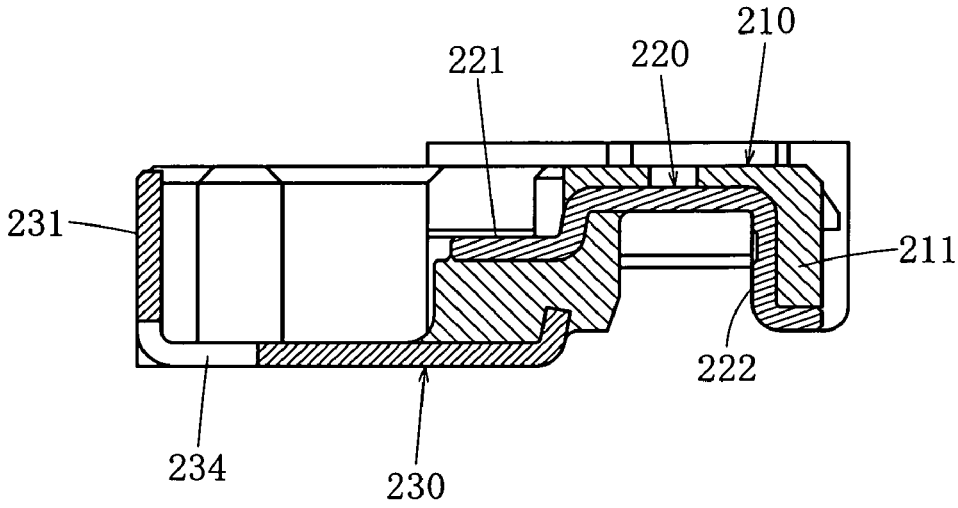
FIG. 8 is an enlarged sectional view along the line VIII-VIII of FIG. 7.
Figure 9:
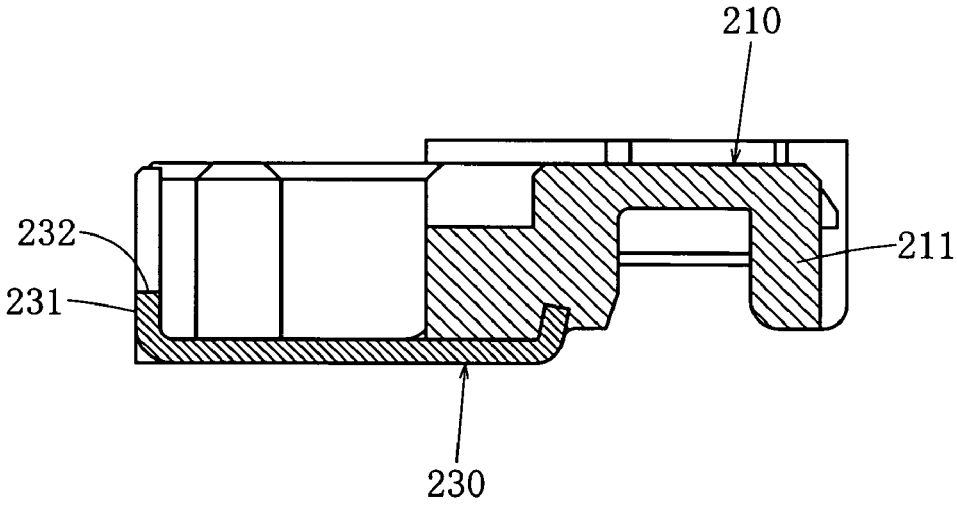
FIG. 9 is an enlarged sectional view along the line IX-IX of FIG. 7.

As shown in FIG. 7 through FIG. 9, the connector body 200 comprises an insulating body housing 210, conductive contacts 220 provided on the body housing 210, and a conductive plate-like plug shell 230 fixed on the body housing 210. The body housing 210 is provided with a fitting part 211 for fitting with a counterpart electric connector. In the case of this embodiment, as shown in FIG. 23 through FIG. 26, a counterpart electric connector 500 is surface-mounted on a mounting surface 610 being a higher-side surface of a member to be mounted 600 such as a printed circuit board, casing or the like, and the electric connector Y is to be connected to the counterpart electric connector 500 or to be disconnected from the counterpart electric connector 500. The counterpart electric connector 500 comprises an insulating housing 510, conductive contacts 520 provided on the housing 510, and a conductive receptacle shell 530 provided to cover the housing 510 and the contacts 520. In the case of this embodiment, a plurality of contacts 520, of which number corresponding to the number of poles, are arranged on the housing 510 side by side in the width direction. The fitting part 211 of the electric connector Y and a fitting part 511 of the counterpart electric connector 500 make concave-convex fitting. In other words, the housing 510 of the counterpart electric connector 500 is provided with the fitting part 511 concaving from a face on the higher side in the height direction toward the lower side. On the other hand, the body housing 210 is provided, at the end on the back side in the depth direction, with a fitting part 211 protruding toward the lower side in the height direction. The receptacle shell 530 is provided with a contact piece 531 extending from the end on the front side in the depth direction thereof toward the lower side to drop into the fitting part 511 of the counterpart electric connector 500. On the other hand, the plug cover shell 300, which will be described later, is provided with a contact piece 330 extending from the end on the back side in the depth direction thereof toward the lower side and forming an end face on the back side of the fitting part 211 of the body housing 210. When the fitting part 211 of the body housing 210 is inserted into the fitting part 511 of the counterpart electric connector 500, the electric connector Y will be connected to the counterpart electric connector 500 by concave-convex fitting. In that case, the contact piece 330 of the plug cover shell 300 and the above contact piece 531 of the receptacle shell 530 will contact each other to make both the shells conductive to each other, and the elastic forces of the shells will contribute to the fitting forces between the electric connector Y and the counterpart electric connector 500. Moreover, the above contact piece 330 of the plug cover shell 300 has, together with a coupling piece 310 and a locking piece 320 to be described later, functions of locking the plug cover shell 300 to the body housing 210. When the electric connector Y is pulled toward the higher side, the electric connector Y will be disconnected from the counterpart electric connector 500. The contact 520 of the counterpart electric connector 500 is provided with a connecting part 521 located on the lower side of the housing 510 and with a contacting part 522 located in the fitting part 511. The connecting part 521 is to be connected to a conducting part on the mounting face 610 by soldering, etc. The counterpart electric connector to be connected with the electric connector of the present invention must not be construed limitedly by the construction of this counterpart electric connector 500; it is sufficient for the counterpart electric connector that it is so structured that it can be connected to the electric connector of the present invention and under such condition their contacts can contact each other.

The body housing 210 is provided with the conductive contact 220. In the case of this embodiment, a plurality of contacts 220, of which number corresponding to the number of poles, are arranged side by side in the width direction on the body housing 210. The contacts 220 are fixed onto the body housing 210 by integrally molding together with the body housing 210. The integral molding is effected by, for example, setting the contacts 220 in the mold for molding the connector body 200 and molding the body housing 210. However, the contacts may be fixed in or onto the body housing by press-fitting or other methods. The contact 220 is provided with a connecting part 221 located on the higher side face of the body housing 210 and with a contacting part 222 located in the fitting part 211, and it is so arranged that when the electric connector Y and the counterpart electric connector 500 are connected together, the contacting part 222 will contact the contacting part 522 of the contact 520 of the counterpart electric connector 500. The contacting forces of these contacts 220, 520 contribute to the fitting forces between the electric connector Y and the counterpart electric connector 500. The connecting part 221 is to be connected to the inner conductor 411 at the end of the shielded cable 400. In this embodiment the inner conductor 411 is connected to the connecting part 221 by soldering. In place of such a connecting mode, the connecting part may be provided with an insulation displacement slot, and it may be insulation-displacement-connected to the inner conductor at the end of the shielded cable; thus in this way the connecting part and the inner conductor at the end of the shielded cable may be connected together.

Figure 19:
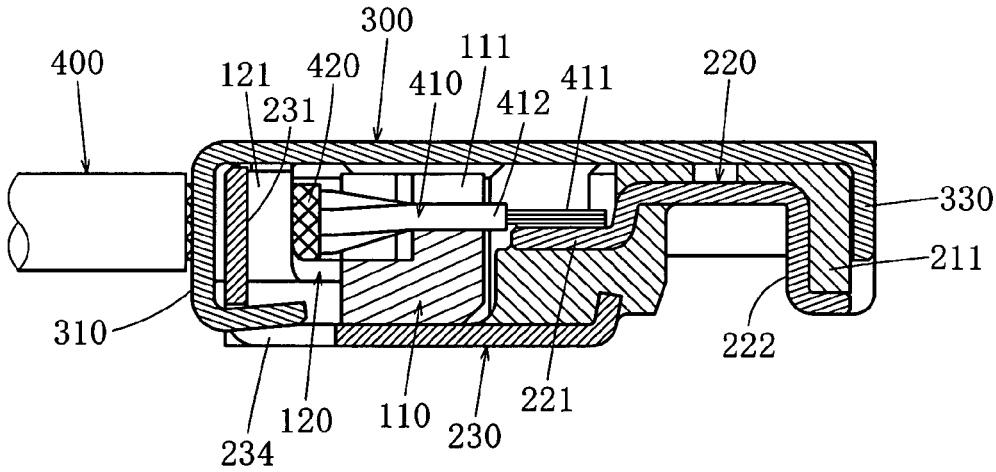
FIG. 19 is an enlarged sectional view along the line XIX-XIX of FIG. 18. The line XIX-XIX passes through the most frontal inner wire, but this inner wire is not illustrated in section.
Figure 20:
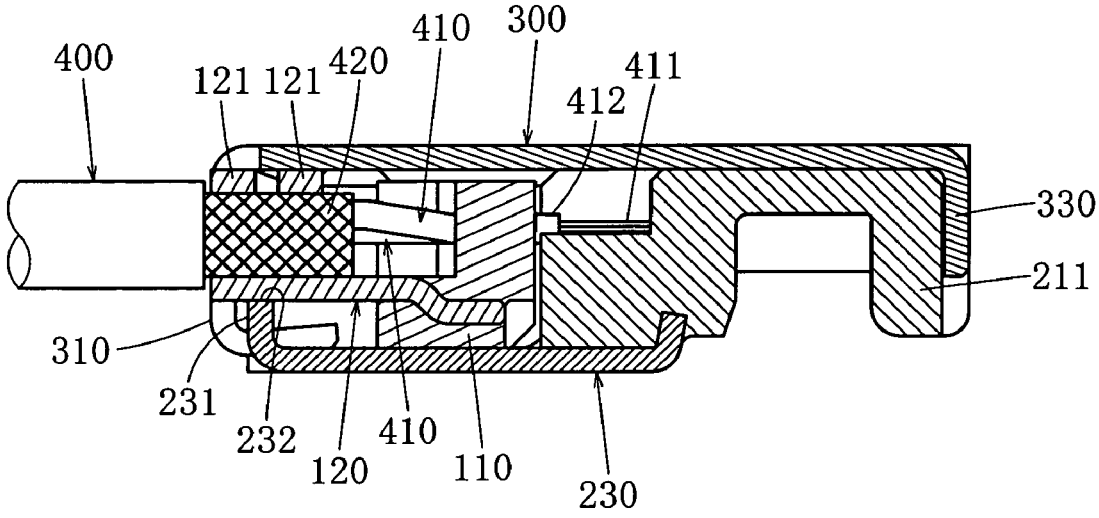
FIG. 20 is an enlarged sectional view along the line XX-XX of FIG. 18. The line XX-XX passes through the shielded cable, but this shielded cable is not illustrated in section. Two frontal inner wires are omitted.
Figure 21:
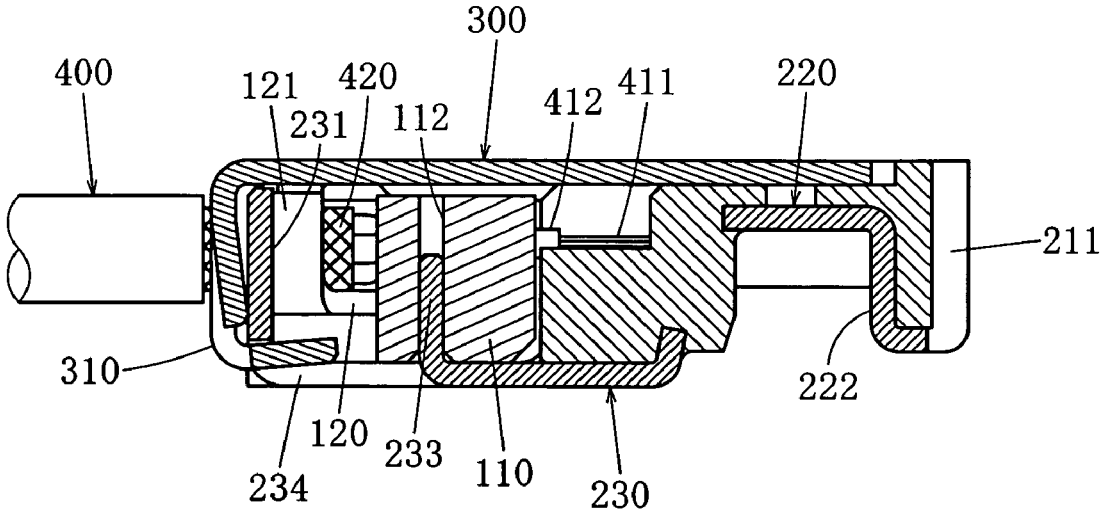
FIG. 21 is an enlarged sectional view along the line XXI-XXI of FIG. 18.
Figure 22:
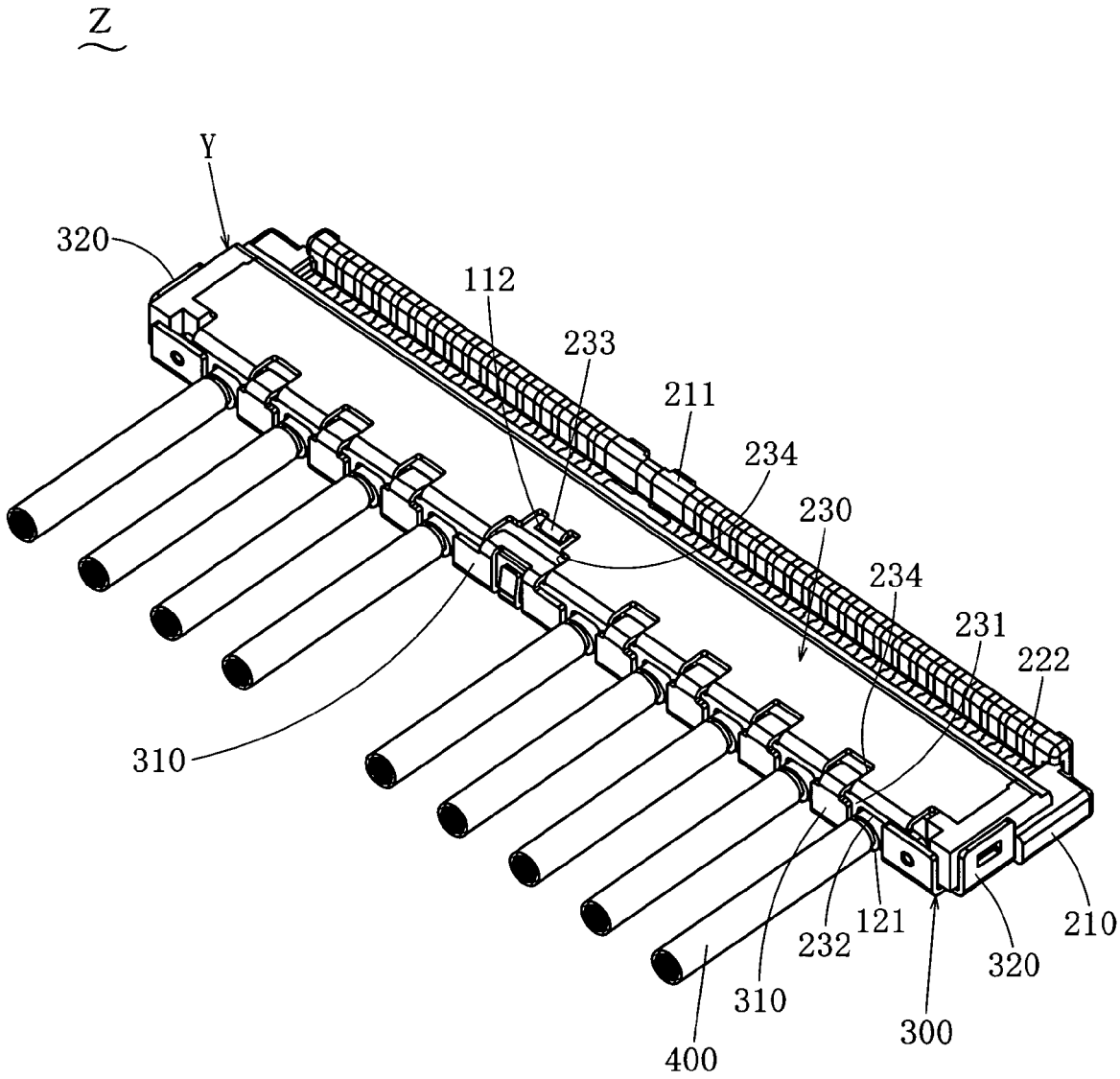
FIG. 22 is a perspective view of the shielded cable harness of the embodiment seen in a direction in which the plug cover shell can be seen.
Figure 23:
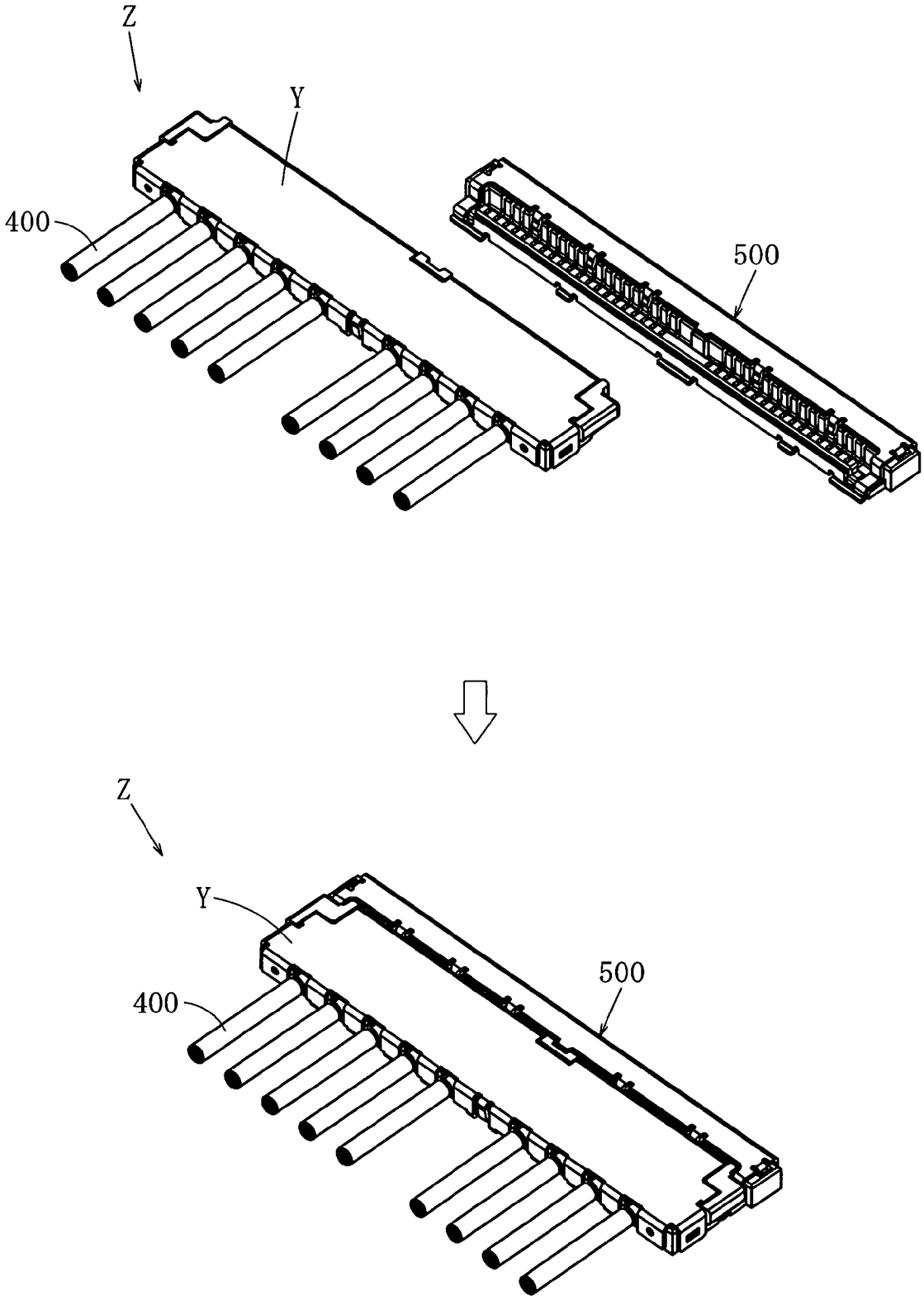
FIG. 23 is a perspective view showing the procedure of connecting the electric connector of the shielded cable harness of the embodiment to a counterpart electric connector.
Figure 24:
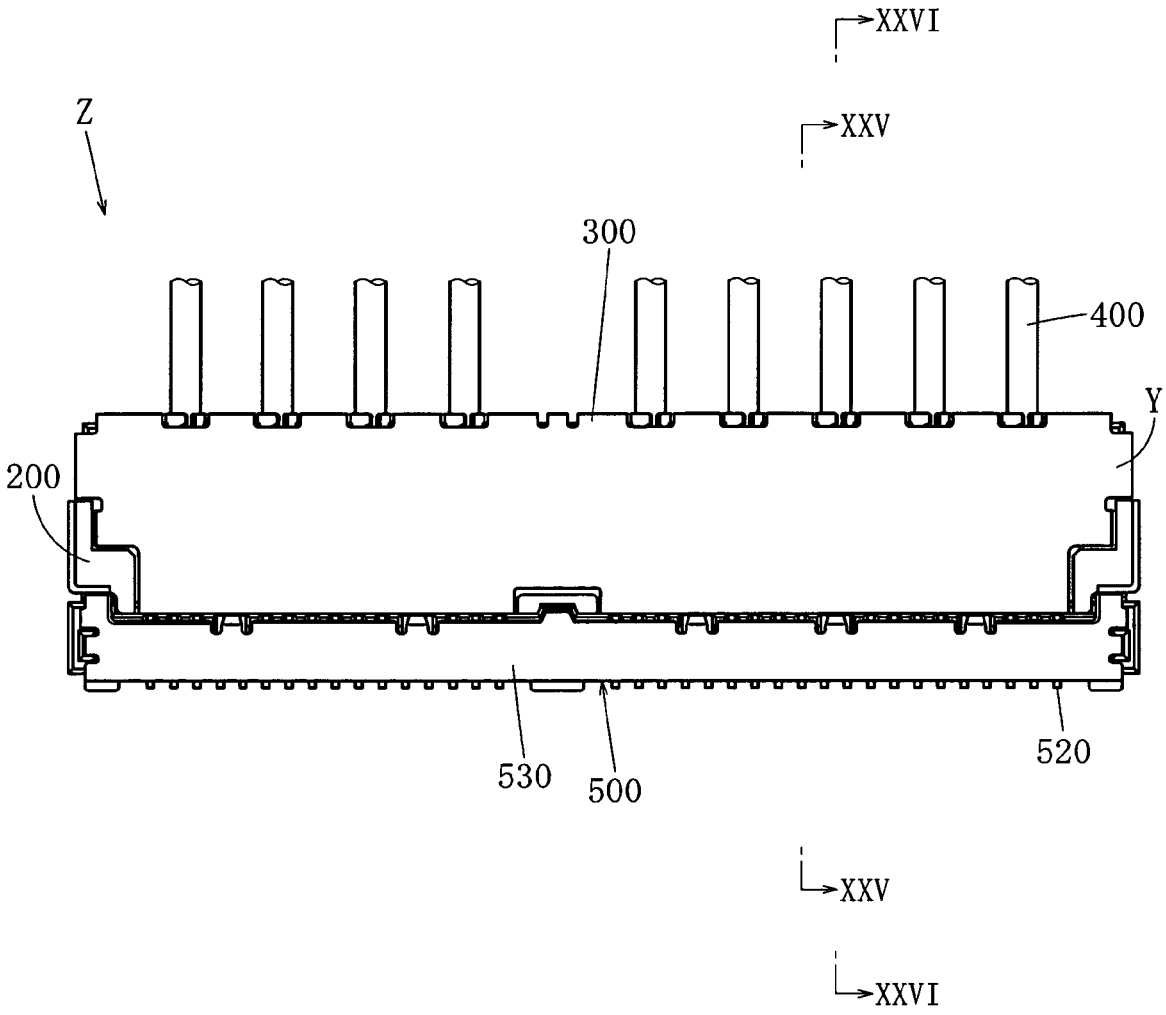
FIG. 24 is a plan view of the electric connector of the shielded cable harness of the embodiment connected to the counterpart electric connector.
Figure 25:
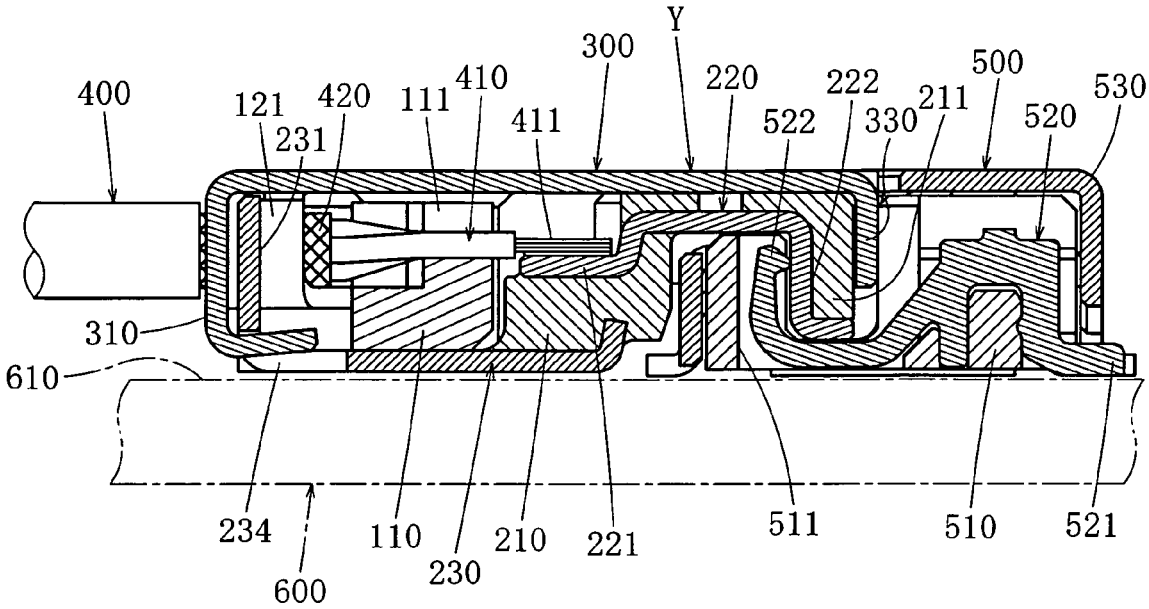
FIG. 25 is an enlarged sectional view along the line XXV-XXV of FIG. 24. The line XXV-XXV passes through the most frontal inner wire, but this inner wire is not illustrated in section.
Figure 26:
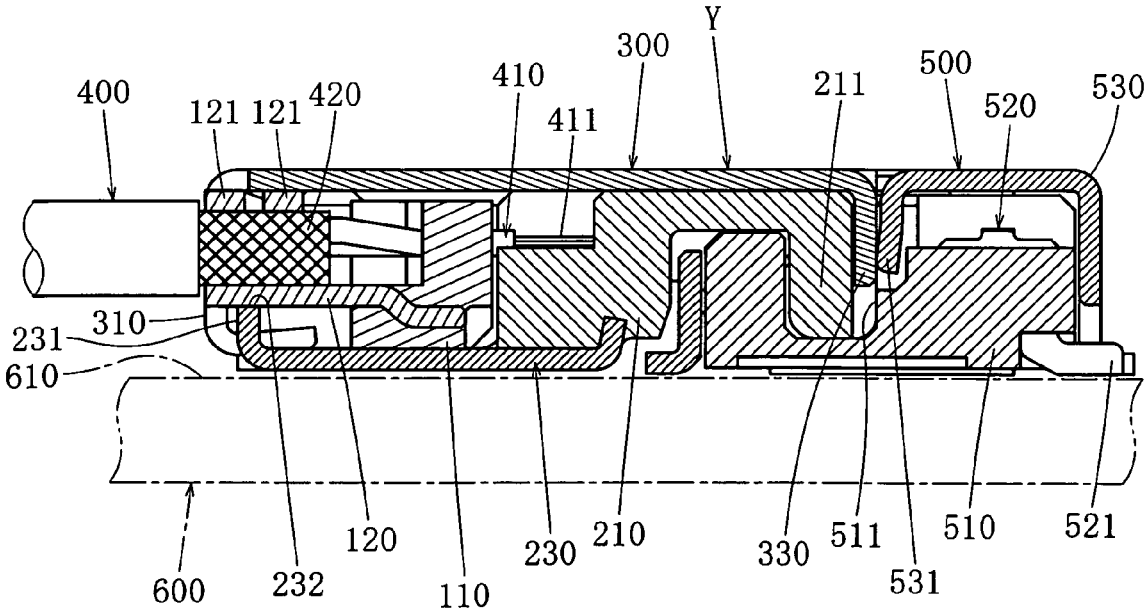
FIG. 26 is an enlarged sectional view along the line XXVI-XXVI of FIG. 24. The line XXVI-XXVI passes through the shielded cable, but this shielded cable is not illustrated in section. Frontal two inner wires are omitted.

The plug shell 230 is arranged on the side lower than the body housing 210 to cover at least a part of the body housing 210 and is fixed onto the body housing 210. The plug shell 230 is fixed onto the body housing 210 by integrally molding it together with the body housing 210. The integral molding is effected by, for example, setting the plug shell 230 in the mold for molding the connector body 200 and molding the body housing 210. However, the plug shell may be fixed onto the body housing by press-fitting the plug shell or other methods. The plug shell 230 is provided with a supporting piece 231 on the front side in the depth direction of the body housing 210, said supporting piece 231 rising from the end on the front side in the depth direction toward the higher side. This supporting piece 231 is provided with a U-shaped slot 232 formed substantially in a U-shape when seen in the depth direction. In the case of this embodiment, the supporting piece 231 is provided with a plurality of U-shaped slots 232, of which number corresponding to the number of poles, being arranged side by side in the width direction. The U-shaped slots 232 are formed to concave substantially in a U-shape from the higher side edge of the supporting piece 231 toward the lower side when seen in the depth direction. It is so arranged that when the barrel 121 is crimped on the outer conductor 420, about one-half perimeter on the lower side of the barrel 121 contacts the U-shape slot 232 from its center in the width direction to both sides thereof, and the higher side of the barrel 121 protrudes from the supporting piece 231 toward the higher side. The width of the U-shaped slot 232 and the width of the barrel 121 crimped on the outer conductor 420 are set in such a fitting relationship that the barrel 121 being crimped on the outer conductor 420 can fit tightly in the U-shaped slot 232. It is also arranged that when the barrel 121 being crimped on the outer conductor 420 is set higher than the U-shaped slot 232 and the barrel 121 is pushed into the U-shaped slot 232, given contact forces will be generated between the barrel 121 and the U-shaped slot 232 to fit them together. As shown in FIG. 19 through FIG. 21, the higher side of the barrel 121 protrudes from the supporting piece 231 toward the higher side, hence when the plug cover shell 300, which will be described later, is placed over the connector body 200 having the press-fitted barrels 121, the barrels 121 will contact the inner face of the plug cover shell 300. The plug shell 230 is provided nearly in the middle in the width direction thereof with a connecting piece 233 rising toward the higher side and being to be fitted into a connecting hole 112 provided in the holder housing 110 nearly in the middle in the width direction thereof. When the connecting piece 233 and the connecting hole 112 are provided, the coupling forces between the holder housing 110 and the plug shell 230 will increase. However, if such a need does not exist, both the connecting piece and the connecting hole may be omitted.

Figure 10:
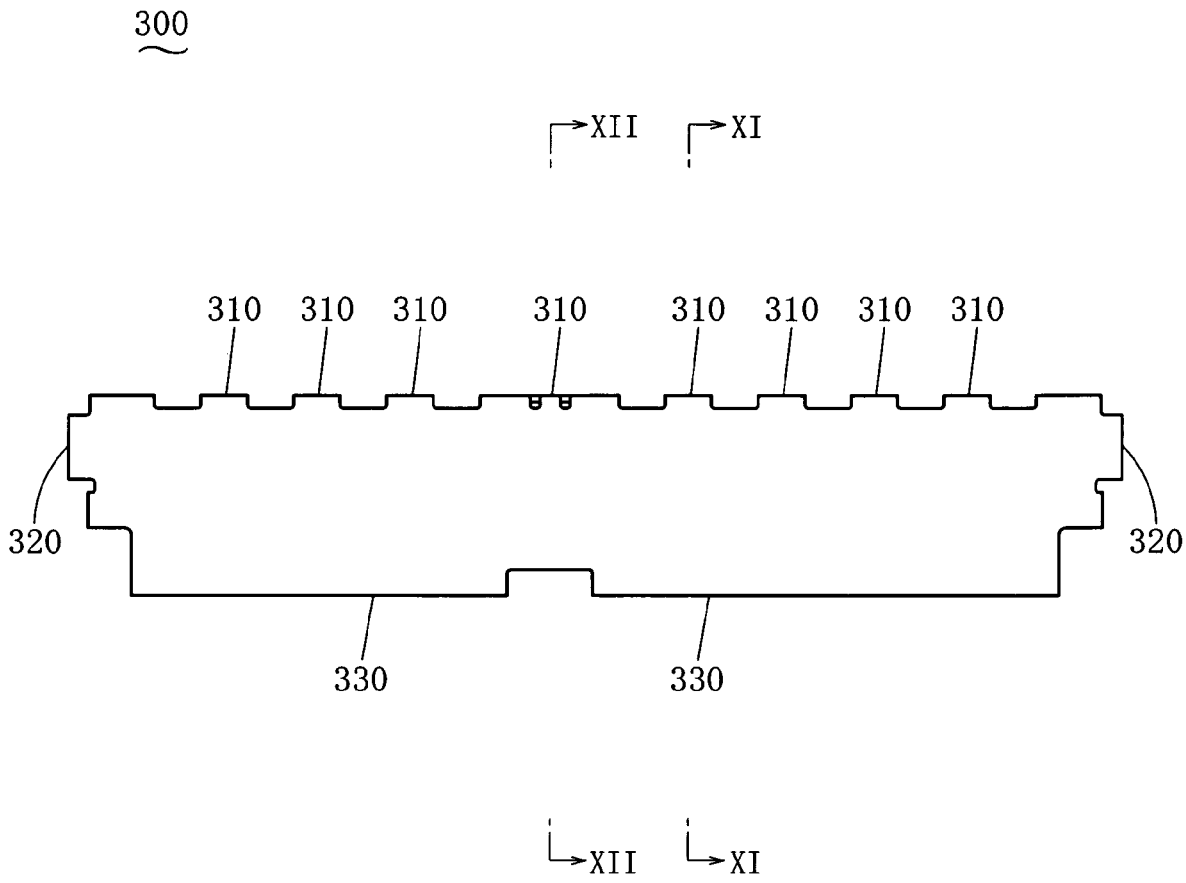
FIG. 10 is a plan view of the plug cover shell of the electric connector assembly kit of the embodiment.
Figure 11:
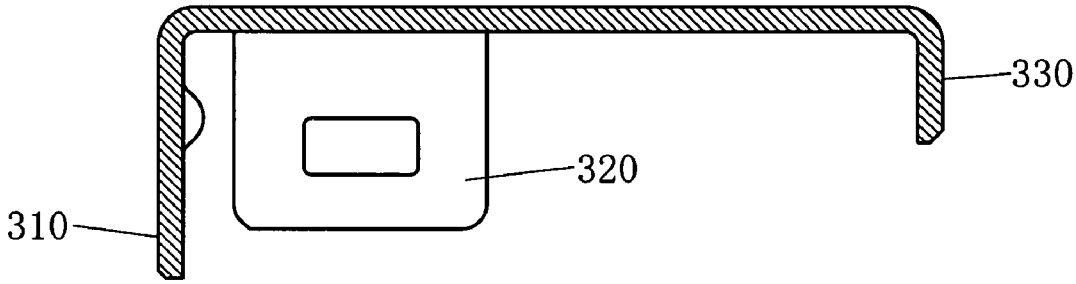
FIG. 11 is an enlarged sectional view along the line XI-XI of FIG. 10.
Figure 12:
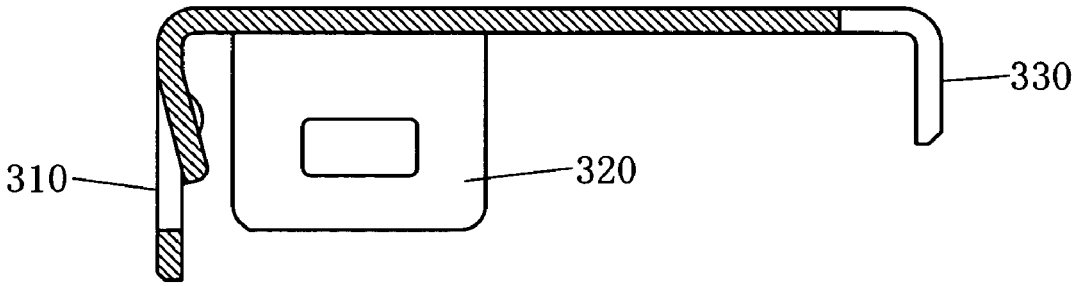
FIG. 12 is an enlarged sectional view along the line XII-XII of FIG. 10.

As shown in FIG. 10 through FIG. 12, the plug cover shell 300 is conductive and is formed in a plate-like form. The plug cover shell 300 is provided with a coupling piece 310 extending from the end on the front side in the depth direction thereof toward the lower side in the height direction. In the case of this embodiment, the plug cover shell 300 is provided with a plurality of coupling pieces 310, of which number corresponding to the number of spaces between poles, side by side in the width direction. The coupling piece 310 has a width being substantially corresponding to the interval between the U-shaped slots 232 of the supporting piece 231 of the plug shell 230. The plug cover shell 300 is also provided with locking pieces 320 extending from the ends in the width direction thereof toward the lower side in the height direction. The locking piece 320 is provided with a locking hole; when a protrusion 212 being provided at the end in the width direction of the body housing 210 of the connector body 200 fits into the locking hole, the plug cover shell 300 will be coupled with the body housing 210. Conversely, a locking piece may be provided with a protrusion and the body housing may be provided with a locking hole. Furthermore, the location of the locking piece is not limited to the end in the width direction of the plug cover shell; another location may be used. When the plug cover shell 300 is provided with the locking pieces 320 and the locking pieces 320 are locked with the body housing 210, the coupling forces between the plug cover shell 300 and the body housing 210 will be increased; however, if it is not needed, the locking pieces may be omitted.

Figure 3:
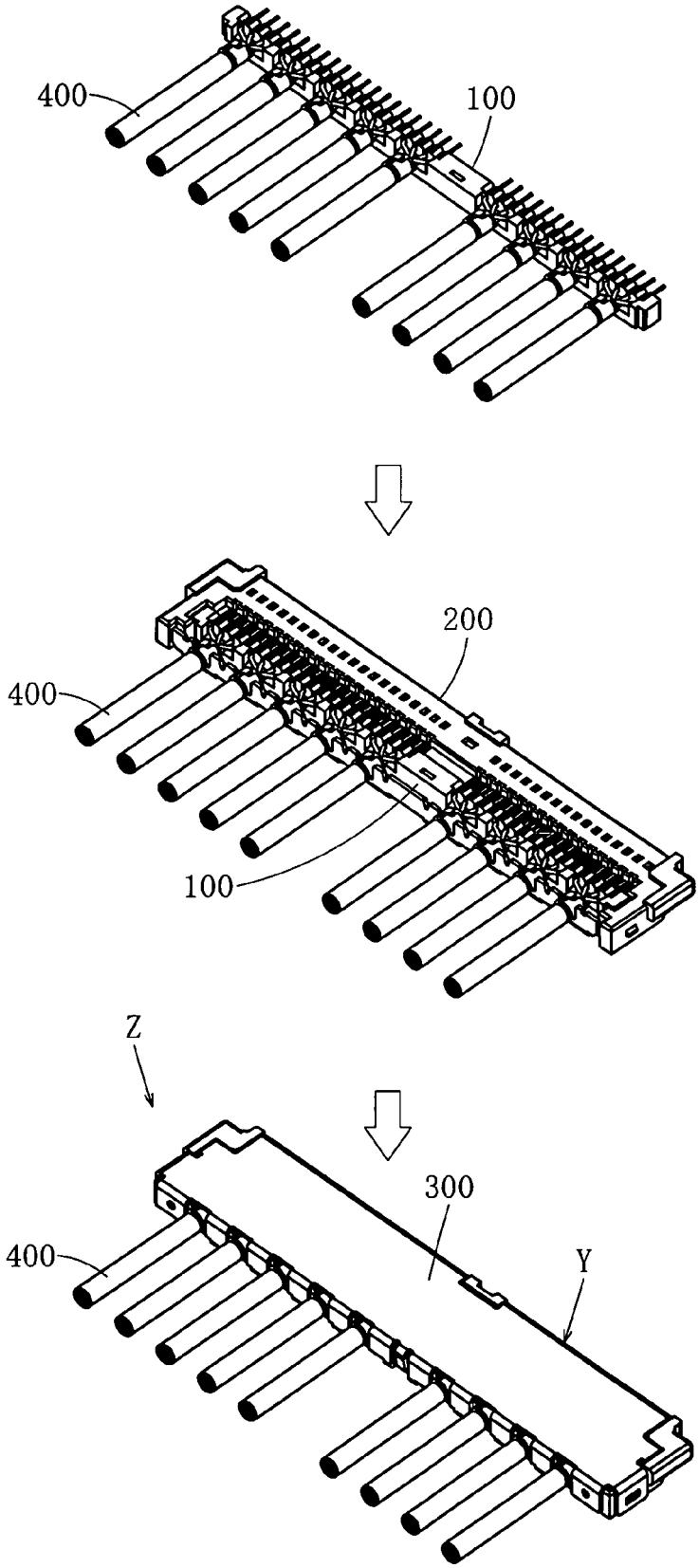
FIG. 3 is a perspective view showing the procedure of assembling a shielded cable harness by connecting the electric connector assembly kit of the embodiment to ends of the shielded cables.
Figure 4:
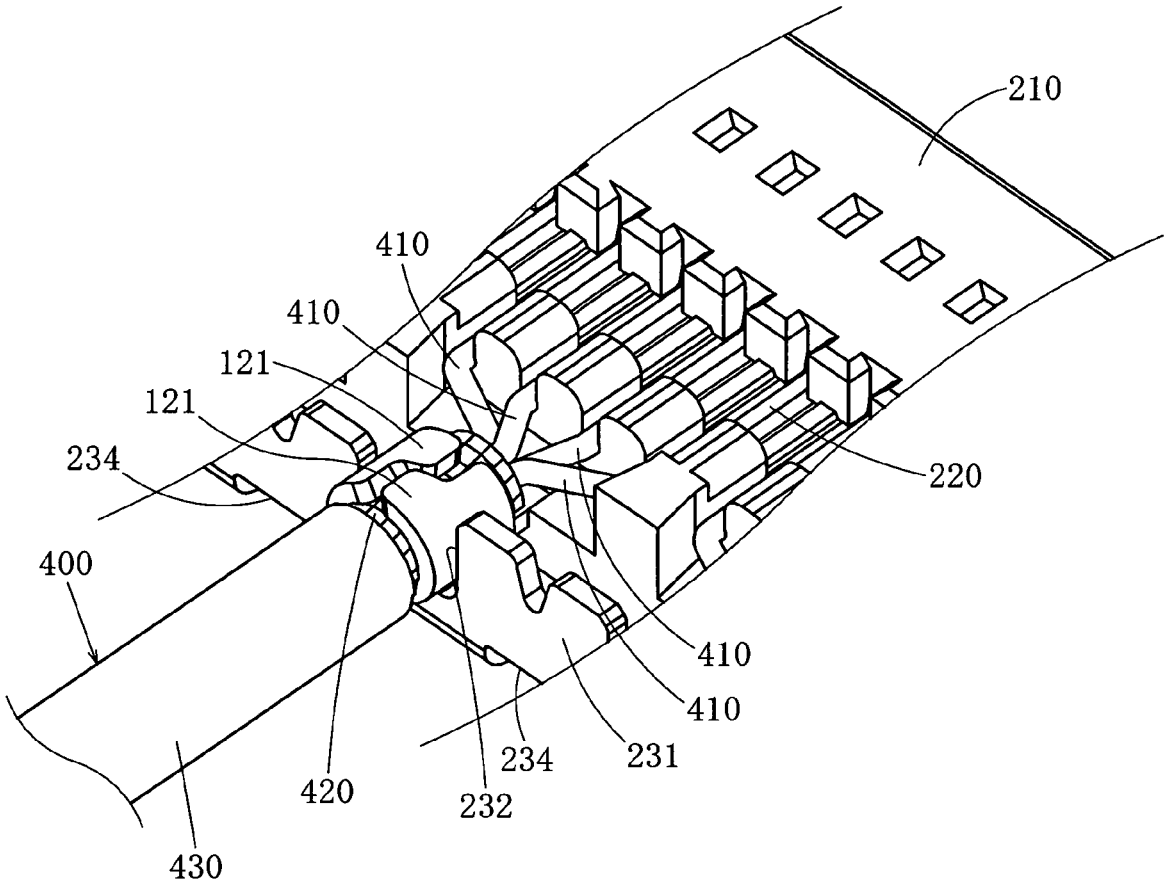
FIG. 4 is an enlarged perspective view showing a relevant part enlarged of the middle diagram of FIG. 3.

As shown in FIG. 3 and FIG. 4, the electric connector assembly kit X is so structured that when the inner wires 410 at the end of the shielded cables 400 are fitted and held in the wire holding parts 111 of the wire holder 100, the outer conductors 420 are crimped by the barrels 121, the connector body 200 is set on the lower side of the wire holder 100 and the inner conductors 411 of the inner wires 410 are connected to the contacts 220 and the barrels 121 are press-fitted in the U-shaped slots 232, the plug cover shell 300 is set on the higher side of the wire holder 100 and is made to contact the barrels 121, the top ends of the coupling pieces 310 extending toward the lower side between U-shaped slots 232 are bent toward the back side in the depth direction to hook on the plug shell 230 from the lower side, the electric connector assembly kit X will be assembled and connected to the ends of the shielded cables 400.

Moreover, between the U-shaped slots 232 of the plug shell 230 are formed the through windows 234 penetrating the plug shell 230. And, it is so structured that when the top ends of the coupling pieces 310 of the plug shell cover 300 are bent toward the back side in the depth direction, the top ends of the coupling pieces 310 will be hooked on the edges on the front side in the depth direction of the through windows 234.

Figure 2:
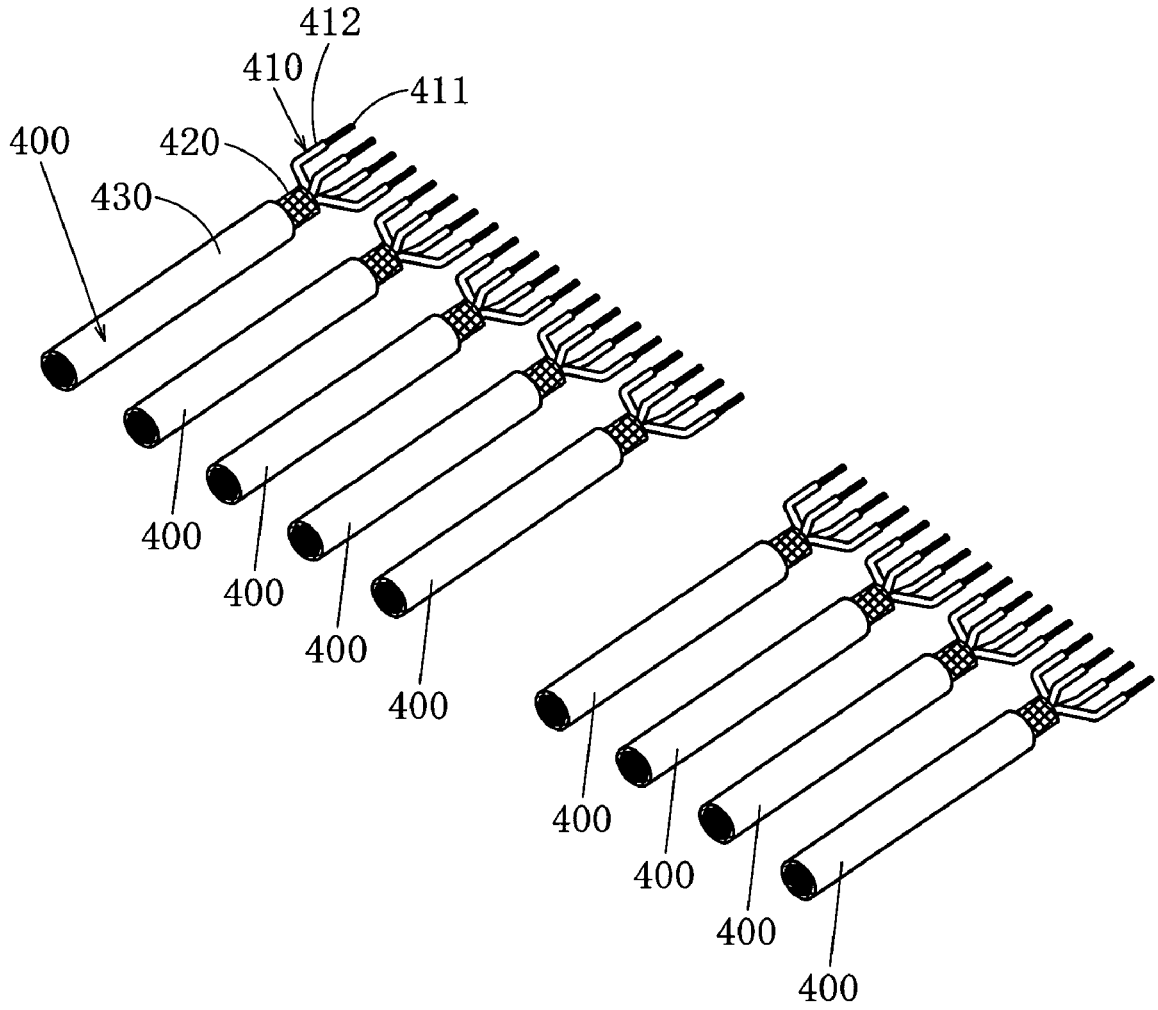
FIG. 2 is a perspective view showing shielded cables to which the electric connector assembly kit of the embodiment are to be connected.
Figure 13:
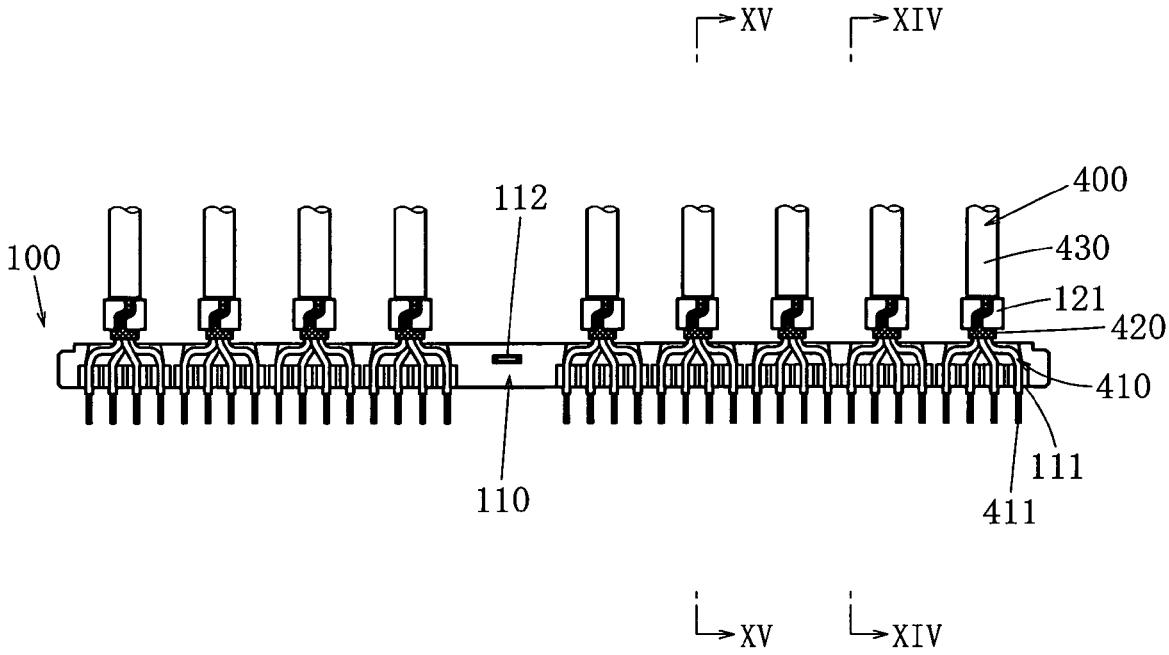
FIG. 13 is a plan view showing the ends of the shielded cables of the embodiment connected to the wire holder.
Figure 14:
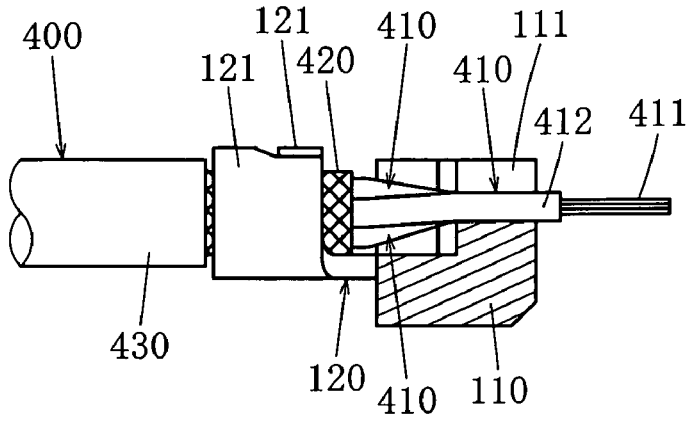
FIG. 14 is an enlarged sectional view along the line XIV-XIV of FIG. 13. The line XIV-XIV passes through the most frontal inner wire, but this inner wire is not illustrated in section.
Figure 15:
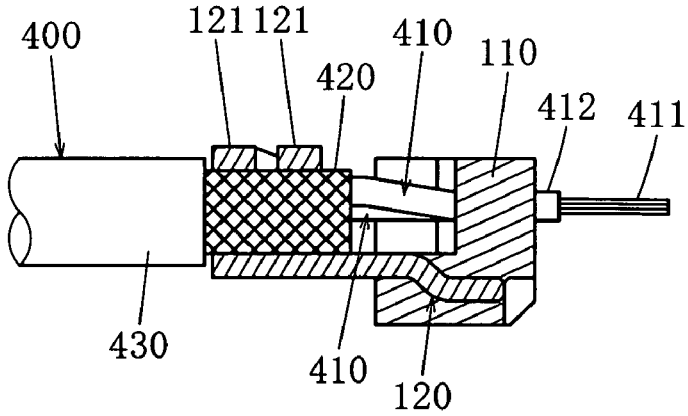
FIG. 15 is an enlarged sectional view along the line XV-XV of FIG. 13. The line XV-XV passes through the shielded cable, but the shielded cable is not illustrated in section. The two inner wires on the front side are omitted.
Figure 16:
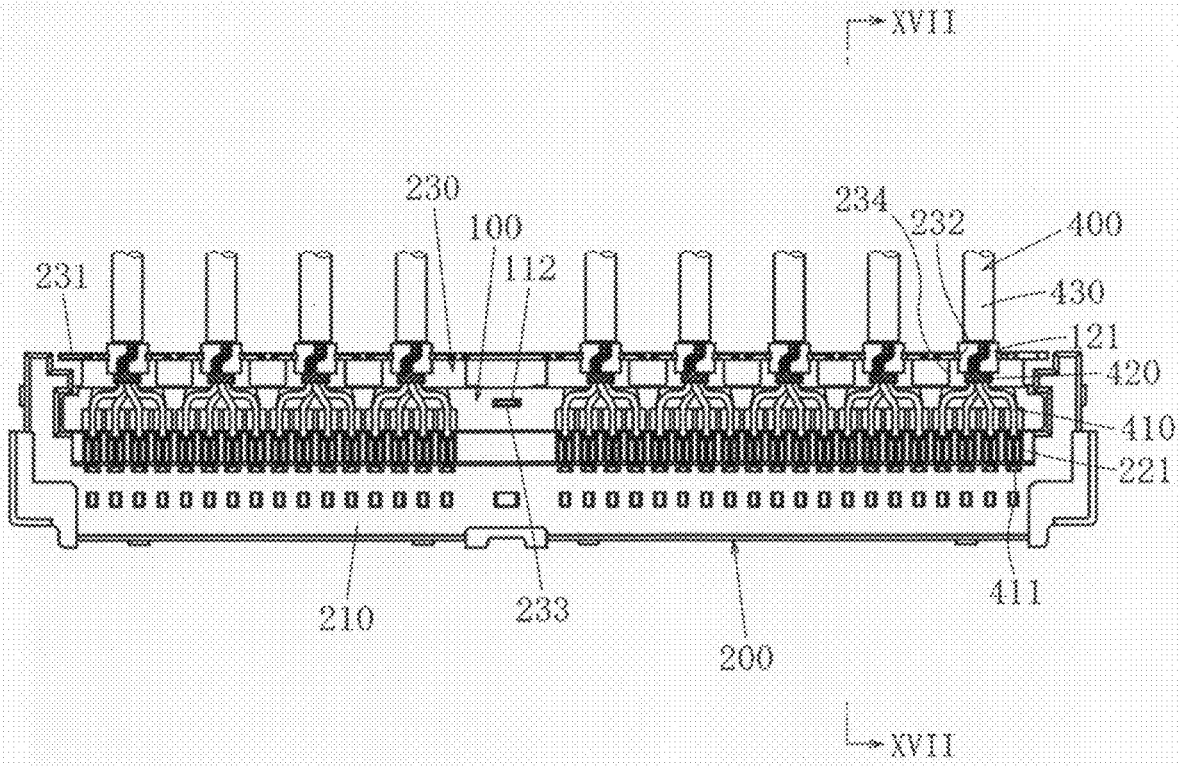
FIG. 16 is a plan view showing the state of the wire holder connected with the shielded cables of the embodiment, the wire holder being coupled with the connector body.
Figure 17:
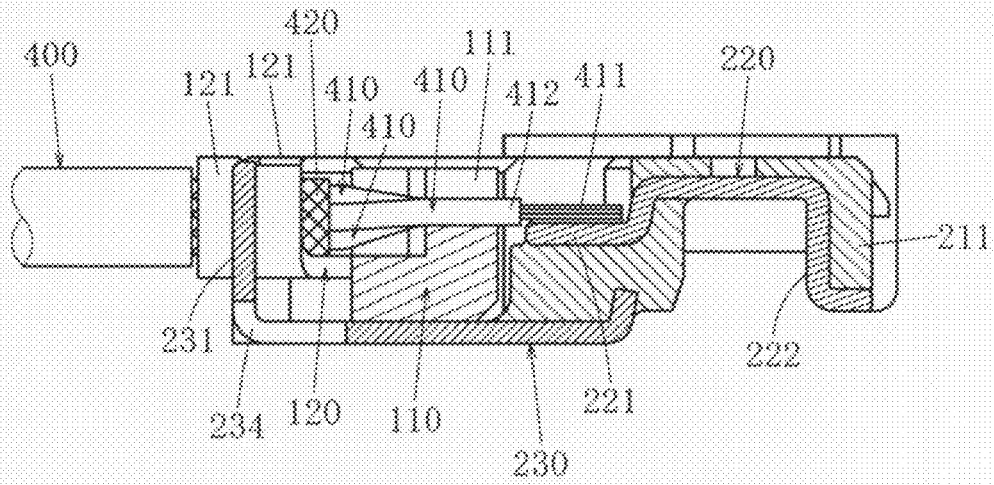
FIG. 17 is an enlarged sectional view along the line XVII-XVII of FIG. 16. The line XVII-XVII passes through the most frontal inner wire, but this inner wire is not illustrated in section.
Figure 18:
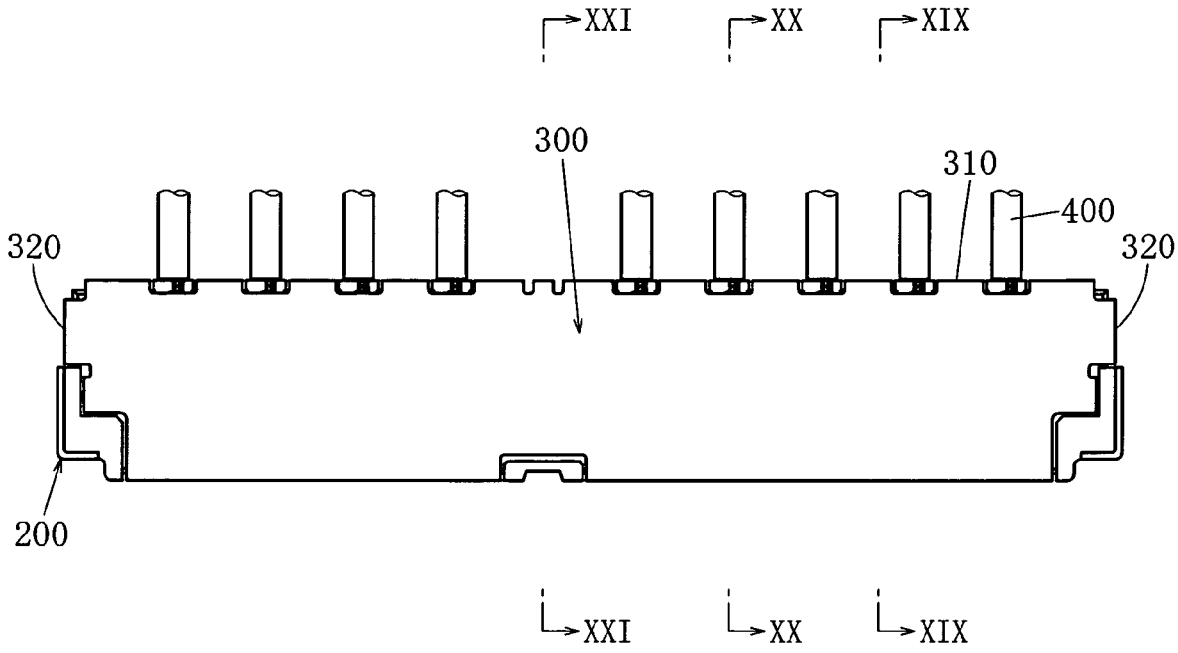
FIG. 18 is a plan view showing the state of the wire holder being connected with the shielded cables of the embodiment, the wire holder being coupled with the connector body, and the connector body being coupled with the plug cover shell.

Next, the operation and effect of the electric connector assembly kit X of the above embodiment will be described. As shown in FIG. 2, the end of the shielded cable 400 is treated in advance to expose, in the order of description toward the top end, the outer conductor 420, the inner wires 410, and the inner conductors 411. In that case, the outer conductor 420 may be folded back to cover the outer insulating coating 430. Next, as shown in FIG. 13 through FIG. 15, the end of each shielded cable 400 is arranged on the higher side of the wire holder 100 in such a way that the top end of the end of the shielded cable 400 is on the back side in the depth direction, the exposed outer conductor 420 is put on the barrel 121 of the barrel contact 120 of the wire holder 100, and the barrel 121 is clamped on the outer conductor 420 to crimp the outer conductor 420. Before or after this crimping operation, the inner wires 410 exposed from the outer conductors 420 are fitted and held in the wire holding parts 111 of the holder housing 110 of the wire holder 100 to lay out the inner wires 410 (refer to FIG. 3). In that case, if necessary, the top ends of the inner wires 410 are cut and trimmed. Next, as shown in FIG. 16 and FIG. 17, the connector body 200 is set on the lower side of the wire holder 100, the barrels 121 of the barrel contacts 120 of the wire holder 100 are press-fitted in the U-shaped slots 232 of the plug shell 230 of the connector body 200 to couple the wire holder 100 with the connector body 200, and the inner conductors 411 of the inner wires 410 are connected to the contacts 220. Then, as shown in FIG. 18 through FIG. 22, the plug cover shell 300 is set on the higher side of the wire holder 100, the coupling pieces 310 are put between barrels 121 press-fitted in the U-shaped slots 232, and the top ends of the coupling pieces 310 are bent toward the back side in the depth direction to hook on the plug shell 230 from the lower side. As a result, a shielded cable harness Z is completed, the harness Z comprising shielded cables 400 and the electric connector Y connected to the ends of the shielded cables 400. Next, as shown in FIG. 23 through FIG. 26, when the fitting part 211 of the body housing 210 is fitted in the fitting part 511 of the counterpart electric connector 500, the contacts 220 will contact the contacts 520 of the counterpart electric connector 500. And, as the outer conductors 420 will become conductive with the barrel contacts 120, the plug shell 230 and the plug cover shell 300, and the plug cover shell 300 will contact the receptacle shell 530 of the counterpart electric connector 500, shielding of both the electric connectors will be made effectively. In this case, the plug shell may be made to contact the receptacle shell of the counterpart electric connector, resulting with effects similar to those of the above embodiment.

In that case, in comparison with a shielded connector wherein the outer conductors of shielded cables are soldered onto the ground plate, the workability of connecting the shielded cables 400 to the electric connector Y is better. Furthermore, as the barrel contacts 120 are fixed to the holder housing 110, the barrel contacts 120 and the holder housing 110 do not move relative to each other. Hence, when the inner wires 410 are being laid out, even if the barrel contact 120 or the holder housing 110 is subjected to any force, the laid-out state will be maintained reliably, and in turn, this will reliably connect the inner wires 410 to the contacts 220, and occurrence of any defective connection or connection failure will be prevented. In particular, when inner wires 410 of the multiple-line shielded cable 400 storing a plurality of inner wires 410 twisted together are being laid out, even if the barrel contact 120 or holder housing 400 is subjected to any restoring force due to residual curl of the inner wires 410, the laid-out state will be maintained reliably, and this in turn will connect the inner wires 410 to the contacts 220 reliably, and occurrence of defective connection or connection failure will be prevented. Moreover, as the barrel contacts 120 and the holder housing 100 do not moved relative to each other, the workability of laying out is enhanced. Furthermore, the barrel contacts 120 enhance the shielding effect, and the transmission characteristics are improved. As the barrels 121 crimp the shielded cables 400, the electric connector Y exhibits a high strength of retaining the shielded cables 400.

Furthermore, as the barrels 121 of the barrel contacts 120 crimp the shielded cables 400, the barrels 121 are press-fitted in the U-shaped slots 232 of the plug shell 230, and the barrels 121 and the plug shell 230 are pinched by a part of the plug cover shell 300 corresponding to the root end of the coupling piece 310 and the coupling piece 310, the connection strength of the electric connector Y and the shielded cables 400 and the assemblage strength of the shell in the electric connector Y against the pulling-about forces of the shielded cables 400 are enhanced significantly in comparison with the conventional ones. Moreover, as no soldering work is required for the outer conductors 420, in comparison with the method of soldering the outer conductor of the end of the shielded cable on to the shell, etc. of the electric connector, the production workability is enhanced, and as the product life extension is not hindered by solder cracking, the performance of the electric connector is maintained over a long period.

It is sufficient that the electric connector assembly kit of the present invention is structured that the plug cover shell is set on the higher side of the wire holder and is made to contact the barrels, and the top ends of the coupling pieces extending to the lower side between the U-shaped slots are bent to the back side in the depth direction to hook on the plug shell from the lower side to assemble onto the end of the shielded cable. However, in the case of the above embodiment, it is so structured that a through window 234 penetrating the plug shell 230 is formed between the U-shaped slots 232 of the plug shell 230, and when the top end of the coupling piece 310 of the plug cover shell 300 is bent toward the back side in the depth direction, the top end of the coupling piece 310 will be hooked on the edge on the front side in the depth direction of the through window 234. With this arrangement, as the connection strength between the plug cover shell 300 and the plug shell 230 is enhanced further, the connection strength between the electric connector Y and the shielded cables 400 and the assemblage strength of the shell in the electric connector Y are enhanced further against the pulling-about forces of the shielded cables 400.

Moreover, with the description of the embodiment above, the following shielded cable harness Z has been disclosed fully. More specifically, the shielded cable harness Z comprises a shielded cable 400 having an inner wire 410 being an inner conductor 411 covered by an inner insulating coating 442, an outer conductor 420 covering the inner wire 410, and an outer insulating coating 430 covering the outer conductor 420, and exposing at the end the outer conductor 420 and the inner wire 410 in this order toward the top end, and an electric connector Y connected to the end of the shielded cable 400. The electric connector Y of this shielded cable harness Z comprises; with reference to a depth direction, a width direction, and a height direction all being perpendicular to each other, a wire holder 100 having an insulating holder housing 110 being provided with a groove-shaped wire holding part 111 for fitting and holding the inner wire 410 being exposed from the outer conductor 420 at the end of the shielded cable 400 and extending substantially in the depth direction, and a conductive barrel contact 120 being fixed to the holder housing 110 and being provided with a barrel 121 being formed substantially into a ring-shape with a separation on the higher side when seen in the depth direction on the front side in the depth direction of the wire holding part 111 of the holder housing 110 for crimping the outer conductor 420 exposed from the outer insulating coating 430 at the end of the shielded cable 400; a connector body 200 having an insulating body housing 210 being set on the lower side of the wire holder 100 and having a fitting part 211 for fitting with a counterpart electric connector 500, a conductive contact 220 being provided on the body housing 210 and connected to the inner conductor 411 at the end of the shielded cable 400 and to contact the contact 520 of the counterpart electric connector 500, and a conductive plate-shaped plug shell 230 being arranged on the lower side of the body housing 210 to cover at least a part of the body housing 210, being fixed onto the body housing 210, and being provided with a supporting piece 231 rising on the front side in the depth direction of the body housing 210 and extending toward the higher side and being provided with a U-shaped slot 232 concaving substantially in a U-shaped form when seen in the depth direction from the higher side edge of the supporting piece 231 toward the lower side and receiving the press-fitted barrel 121 crimped on the outer conductor 420 with the barrel's lower substantially half circumference contacting the U-shaped slot 232 and the barrel's higher side protruding toward the higher side from the supporting piece 231; and a conductive plate-shaped plug cover shell 300 being set on the higher side of the wire holder 100 to contact the barrel 121 and having a coupling piece 310 having a width substantially corresponding to the part between the U-shaped slots 232 in the supporting piece 231 of the plug shell 230 and extending from the front side in the depth direction toward the lower side, of which top end being bent to the back side in the depth direction and hooked on the plug shell 230 from the lower side. Moreover, with the description of the embodiment above, the following shielded cable harness Z has been described fully. More specifically, in this shielded cable harness Z a through window 234 penetrating the plug shell 230 is formed between the U-shaped slots 232 of the plug shell 230, and the top end of the coupling piece 310 of the plug cover shell 300 is hooked on the edge on the front side in the depth direction of the through window 234.

The barrel contact 120, the plug shell 230 and the plug cover shell 300 of the electric connector assembly kit X of the above embodiment are all made of metal, but they may be made of other materials provided the materials are conductive. Moreover, the electric connector assembly kit X of the above embodiment is provided with a plurality of poles, but it may be of a single pole. The electric connector assembly kit of the present invention may be connected to only a shielded cable, but it also may be connected, in addition to a shielded cable, to an independent covered wire comprising a conductor and an insulating coating covering the conductor. These points are also applicable to the shielded cable harness Z of the above embodiment. The electric connector assembly kit of the present invention includes all embodiments wherein features of the electric connector assembly kit of the embodiment above are combined. The shielded cable harness of the present invention includes all the embodiments wherein the features of the electric connector of the embodiment above are combined.

The disclosure of Japanese Patent Application No. 2007-232108 filed on Sep. 6, 2007 including specification, drawings and claims is incorporated herein by reference in its entirety. The disclosure of Japanese Patent Application No. 2008-179633 filed on Jul. 9, 2008 including specification, drawings and claims is incorporated herein by reference in its entirety.

The invention claimed is:

1. An electric connector assembly kit to be assembled onto an end of a shielded cable comprising an inner wire being an inner conductor covered by an inner insulating coating, an outer conductor covering the inner wire, and an outer insulating coating covering the outer conductor, said electric connector assembly kit comprising;

with reference to a depth direction, a width direction, and a height direction all being perpendicular to each other, a wire holder having an insulating holder housing being provided with a groove-shaped wire holding part for holding the inner wire being exposed from the outer conductor at the end of the shielded cable and extending substantially in the depth direction, and a conductive barrel contact being fixed to the holder housing and being provided with a barrel being formed substantially into a U-shape when seen in the depth direction on the front side in the depth direction of the wire holding part of the holder housing for crimping the outer conductor exposed from the outer insulating coating at the end of the shielded cable;

a connector body having an insulating body housing having a fitting part for fitting with a counterpart electric connector, a conductive contact being provided on the body housing and being to be connected to the inner conductor at the end of the shielded cable and to contact the contact of the counterpart electric connector, and a conductive plate-shaped plug shell being arranged on a lower side of the body housing to cover at least a part of the body housing, being fixed onto the body housing, and being provided with a supporting piece rising on a front side in the depth direction of the body housing and extending toward a higher side edge and being provided with a U-shaped slot concaving substantially in a U-shaped form when seen in the depth direction from the higher side edge of the supporting piece toward the lower side and being to receive the conductive barrel crimped on the outer conductor a lower circumferential half of the conductive barrel contacting the U-shaped slot and an upper circumferential half of the conductive barrel protruding toward the higher side from the supporting piece; and a conductive plate-shaped plug cover shell having a coupling piece having a width substantially corresponding to the part between the U-shaped slots in the supporting piece of the plug shell and extending from the front side in the depth direction toward the lower side;

said electric connector assembly kit being structured that the inner wire of the end of the shielded cable being fitted and held in the wire holding part of the wire holder and the outer conductor being crimped by the conductive barrel, the connector body being set on the lower side of the wire holder, the inner conductor of the inner wire being connected to the contact and the conductive barrel being press-fitted in the U-shaped slot, the plug cover shell being set on the higher side of the wire holder and fitted with the barrel, and the top end of the coupling piece extending toward the lower side between the U-shaped slots and being bent toward a back side of the conductive plate-shape plug shell in the depth direction and hooked on the plug shell from the lower side to assemble onto the end of the shielded cable.

2. The electric connector assembly kit according to claim 1, wherein the electric connector assembly kit is structured that a through window penetrating the plug shell is formed between the U-shaped slots of said plug shell, and when the top end of the coupling piece of the plug shell is bent toward the back side in the depth direction, the top end of the coupling piece will be hooked on the edge on the front side in the depth direction of the through window.

3. A shielded cable harness comprising a shielded cable having an inner wire being an inner conductor covered by an inner insulating coating, an outer conductor covering the inner wire, and an outer insulating coating covering the outer conductor, and exposing at the end the outer conductor and the inner wire in this order toward the top end, and an electric connector connected to the end of the shielded cable;

said electric connector comprising;

with reference to a depth direction, a width direction, and a height direction all being perpendicular to each other, a wire holder having an insulating holder housing being provided with a groove-shaped wire holding part for fitting and holding the inner wire being exposed from the outer conductor at the end of the shielded cable and extending substantially in the depth direction, and a conductive barrel contact being fixed to the holder housing and being provided with a barrel being formed substantially into a ring-shape with a separation on the higher side when seen in the depth direction on the front side in the depth direction of the wire holding part of the holder housing for crimping the outer conductor exposed from the outer insulating coating at the end of the shielded cable;

a connector body having an insulating body housing being set on a lower side of the wire holder and having a fitting part for fitting with a counterpart electric connector, a conductive contact being provided on the body housing and connected to the inner conductor at the end of the shielded cable and to contact the contact of the counterpart electric connector, and a conductive plate-shaped plug shell being arranged on the lower side of the body housing to cover at least a part of the body housing, being fixed onto the body housing, and being provided with a supporting piece rising on a front side in the depth direction of the body housing and extending toward a higher side and being provided with a U-shaped slot concaving substantially in a U-shaped form when seen in the depth direction from the higher side edge of the supporting piece toward the lower side and receiving the conductive barrel crimped on the outer conductor with a lower circumferential half of the conductive barrel contacting the U-shaped slot and an upper circumferential half of the conductive barrel protruding toward the higher side from the supporting piece; and a conductive plate-shaped plug cover shell being set on the higher side of the wire holder to contact the conductive barrel and having a coupling piece having a width substantially corresponding to a portion between the U-shaped slot in the supporting piece of the plug shell and extending from the front side in the depth direction toward a lower side, of which a top end being bent to the back side in the depth direction and hooked on the plug shell from the lower side thereof.

4. The shielded cable harness according to claim 3, wherein a through window penetrating the plug shell is formed between U-shaped slots of said plug shell and the top end of the coupling piece of the plug cover shell is hooked on the edge on the front side in the depth direction of the through window.

* * * * *